US005903218A

United States Patent [19]

Nelson

[11] Patent Number: 5,903,218

[45] Date of Patent: May 11, 1999

[54] POOL ALARM

[75] Inventor: Alan Nelson, Los Gatos, Calif.

[73] Assignee: Vigilant Systems, Inc., San Mateo, Calif.

[21] Appl. No.: 09/131,767

[22] Filed: Aug. 10, 1998

[51] Int. Cl.[6] ..... G08B 23/00

[52] U.S. Cl. ..... 340/573.6; 340/611; 340/614; 340/626

[58] Field of Search ..... 340/573.1, 573.6, 340/611, 614, 626, 566; 367/136, 141

[56] References Cited

U.S. PATENT DOCUMENTS

| | | | |
|---|---|---|---|
| 3,760,396 | 9/1973 | Haselton | 340/573.6 |
| 5,121,104 | 6/1992 | Nelson et al. | 340/573.6 |
| 5,268,673 | 12/1993 | Nelson et al. | 340/573.6 |
| 5,325,086 | 6/1994 | Thomas | 340/620 |

*Primary Examiner*—Nina Tong
*Attorney, Agent, or Firm*—Claude A.S. Hamrick; Oppenheimer W. Donnelly; Justin Boyce

[57] ABSTRACT

A wave motion detector system for a swimming pool includes a transducer responsive to positive and negative pressure changes in swimming pool water and operative to generate corresponding electrical signals. Comparators are responsive to the electrical signals, and operative to generate a crest signal while the positive pressure exceeds a predetermined positive threshold level, and a trough signal while the negative pressure exceeds a predetermined negative threshold level. A band pass filter prevents electrical signals having a frequency greater than a predetermined upper frequency, and lower than a predetermined lower frequency from passing from the transducer to the comparators. A pulse width discriminator is responsive to the crest signal and the trough signal and is operative to generate a qualified crest signal if the crest signal remains active for a first predetermined time interval, and a qualified trough signal if the trough signal remains active for a second predetermined time interval. A counter circuit, responsive to the qualified crest signal and the qualified trough signal, determines a count value which is equal to the number of times the qualified trough signal and the qualified crest signal occur during a counting time interval. A processing circuit includes alarm condition detection circuitry responsive to the count value, and operative to generate an alarm signal if the count value is greater than or equal to a predetermined alarm count value. Annunciator means, responsive to the alarm signal, is operative to indicate an alarm condition if the alarm signal is generated.

20 Claims, 22 Drawing Sheets

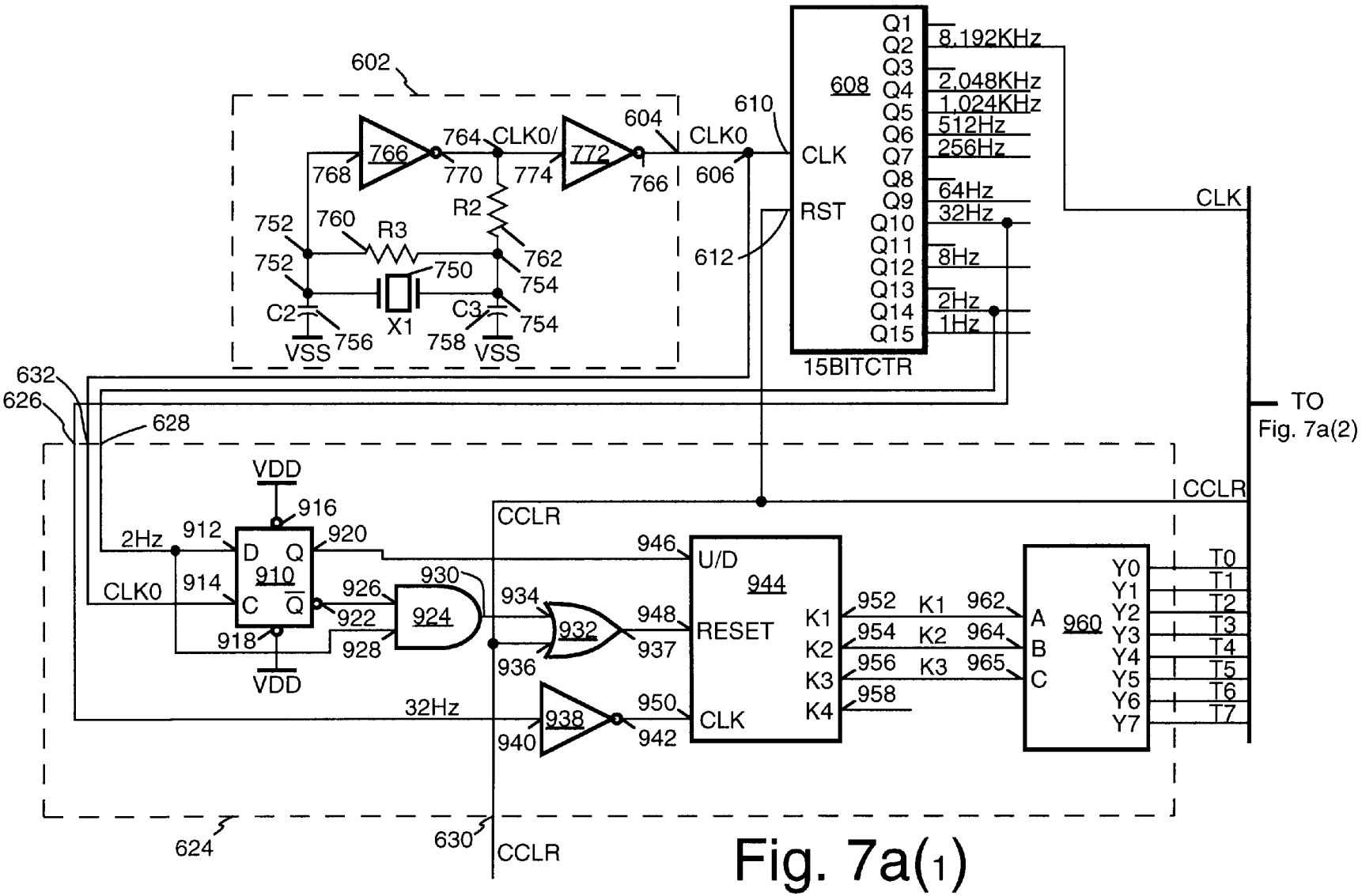
Fig. 7a(1)

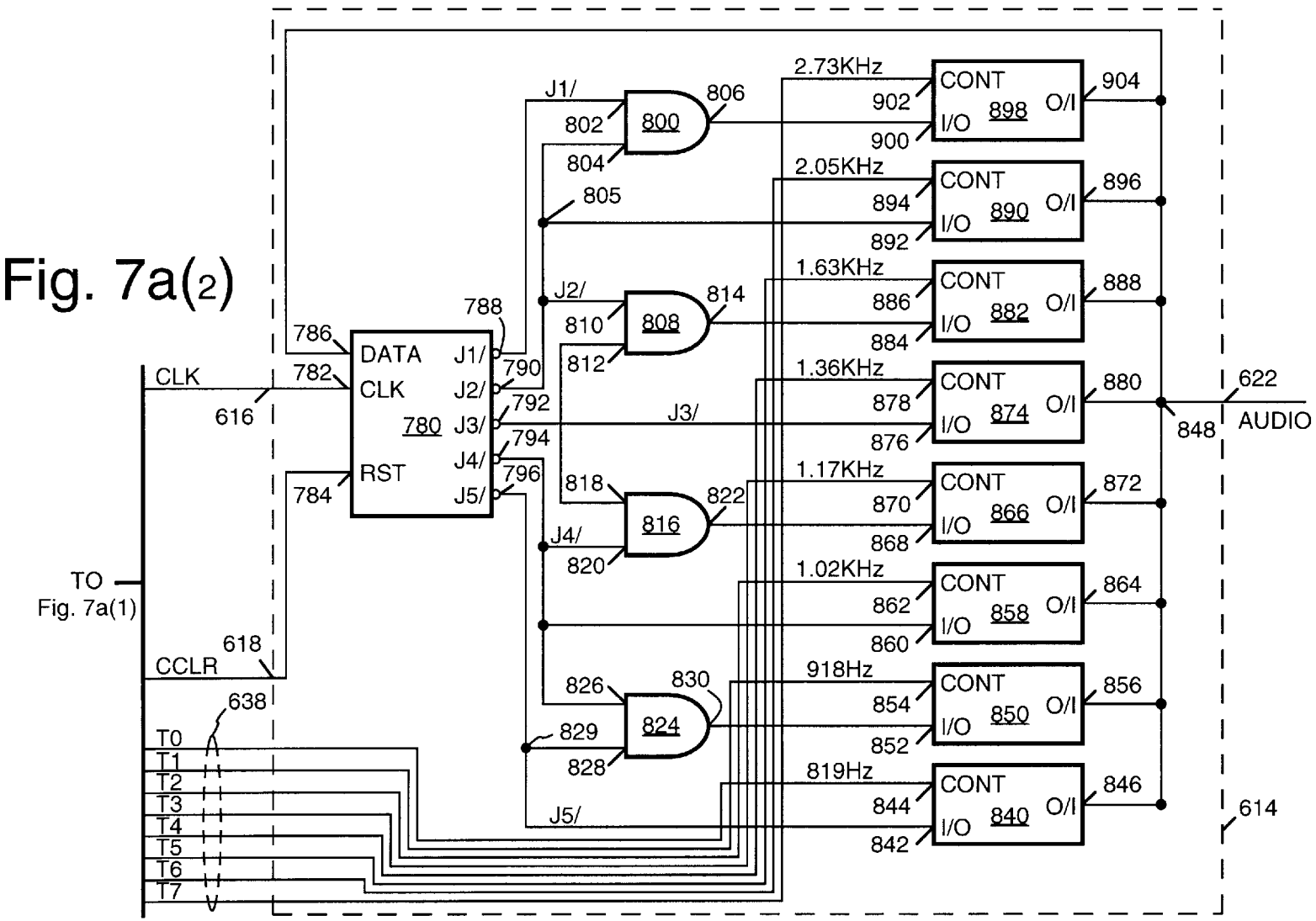
Fig. 7a(2)

POR
20
16
4BITCTR
1594
1596
1598
1602
1592
1586
1588
1590
64Hz
D2
D2/
1566
1572
1574
1560
1562
1564
1568
1570
VDD
1552
1558
1554
1556
1576
1582
1578
1580
T
1544
1550
1546
1548
1516
1541
1508
1514
LATCH
1502
1504
1506
1512
1510
D1/
1531
1530
1526
1520
1524
1528
1532
D1
1536
1542
1538
1540
1522
CL/
1726
1720
1722
1724
4.5SEC
1716
1712
1710
1600
1704
1714
1694
1696
1698
1700
1702
1614
1533
1784
1778
1786
1782
1776
1770
1772
1774
1808
1812
1814
1802
1804
1806
1810
1793
OS/
1764
1758
1760
1762
1756
1750
1752
1754
1796
1790
1792
1794
1798
1800
1614
ON
122
ON/
74
1640
90
ALARM
17 MIN
1744
17 MIN TIMER
1740
1742
ENBL
1730
1732
1734
1736
1640
1684
1686
1688
1690
I-SEC
1678
1674
CL1
1680
1682
1668
1670
1672
1628
1630
1632
1634
1660
1662
1664
1666
1610
1612
1616
1618
1620
1622
1624
1626
1652
1654
1657
1658
1650
1648
1636
1642
1646
1638
1641
1644
500
CC
18
OND/
114
OND2/
118
64Hz
102
8Hz
106
2Hz
110
TWO
98

POOL ALARM

BACKGROUND OF THE INVENTION

1. Field of the Invention

This invention relates generally to pool alarms, and more particularly to an improved swimming pool alarm that is sensitive to wave motion but can discriminate between disturbances caused by entry of a small child or animal into the pool and those caused by wind, rain, and other effects.

2. Description of the Prior Art

Pool alarm systems typically include a transducer placed below the water surface which detects disturbances in the water. Commonly, the transducer is either an acoustic transducer which detects high frequency sound waves in the water, or a pressure transducer which detects low frequency waves. Mechanical vanes and tilt switches have also been employed as transducers in pool alarms. One problem with prior art pool alarm systems is that wave analysis circuitry of the systems is often unable to differentiate between wave motion caused by normal extraneous stimuli (e.g., wind, rain, automatic pool cleaning apparatus) and wave motion caused by entry of a small child or animal into the pool. Several prior art pool alarm systems include wave analysis circuitry for filtering, comparing, and otherwise processing signals generated by the transducer to determine whether a wave disturbance sensed by the transducer is consistent with a wave caused by a child or animal entering the water, in which case an alarm is sounded.

Applicants previous patent, U.S. Pat. No. 5,121,104 discloses a pool alarm including: a pressure transducer responsive to pressure variations and operative to generate a signal representing waves; an amplifier connected to the transducer to set the signal level; a low frequency band pass filter connected to the amplifier output for filtering out wind, rain and pool side traffic; a comparator amplifier for comparing the filter output to a fixed threshold voltage; and a periodicity discriminator to determine if an apparent wave is periodic and if the period is consistent with that of a wave caused by a small child or animal entering the water. If the signal output from the filter exceeds the fixed threshold voltage of the comparator twice within a preset duration of time, an audio alarm is sounded.

One important problem with prior art pool alarm systems is false alarms in response to wind gusts. Also, while strong wind gusts are incident upon a swimming pool, wave motion characterized by wide crests, or swells may be generated such that the entry into the pool of a small child or animal will be obscured and therefore unlikely to be detected. What is needed is a pool alarm system which activates a disturbance warning, distinguishable from the audio alarm indicating entry of a small child or animal into the pool, wherein the disturbance warning is activated in response to a disturbance characterized by wide crests or swells which could obscure the entrance of a small child or animal into the pool.

Another problem with prior swimming pool alarm systems is that the alarm systems may be easily disarmed by a child thereby allowing children or small animals to enter the pool without triggering the alarm. Furthermore, an adult who disarms the alarm system in order to go swimming may forget to turn the alarm back on after swimming.

What is needed is a pool alarm system having a child-proof deactivation procedure. What is also needed is a pool alarm system which automatically turns on after a fixed period of time during which no one is swimming in the pool.

An additional problem with prior art pool alarm systems is that the power supply, usually batteries, may be OFF or may become too low to operate the alarm system. What is needed is a battery operated pool alarm system which periodically indicates to a user that the battery power supply is low so that batteries may be replaced.

SUMMARY OF THE INVENTION

It is therefore a primary objective of the present invention to provide an apparatus and method for analyzing wave motion in order to detect the entrance of a small child or animal into a swimming pool and trigger an alarm when it has detected such an entrance into the pool.

Another objective of the present invention is to provide a disturbance warning, distinguishable from the alarm indicating entry of a small child or animal into the pool, wherein the disturbance warning is activated in response to a disturbance characterized by wide crests or swells which could obscure the entrance of a small child or animal into the pool.

A further objective of the present invention is to provide a pool alarm system which automatically turns on after a fixed period of time during which no one is swimming in the pool.

Yet another objective of the present invention is to provide a pool alarm system requiring a child-proof deactivation procedure.

Yet one more objective of the present invention is to provide a battery operated pool alarm system which periodically indicates to a user that the battery power supply is low so that batteries may be replaced.

A wave motion detector system for a swimming pool includes a transducer responsive to positive and negative pressure changes in swimming pool water and operative to generate corresponding electrical signals. A pair of comparators are responsive to the electrical signals, and are operative to generate a crest signal while the positive pressure exceeds a predetermined positive threshold level, and a trough signal while the negative pressure is more negative than a predetermined negative threshold level. A band pass filter prevents electrical signals having a frequency greater than a predetermined upper frequency, and lower than a predetermined lower frequency from passing from the transducer to the comparators.

A pulse width discriminator is responsive to the crest signal and the trough signal and is operative to generate a qualified crest signal if the crest signal remains active for a first predetermined time interval, and a qualified trough signal if the trough signal remains active for a second predetermined time interval. A counter circuit, responsive to the qualified crest signal and the qualified trough signal, determines a count value which is equal to the number of times the qualified trough signal and the qualified crest signal occur during a counting time interval.

A processing circuit includes alarm condition detection circuitry responsive to the count value, and operative to generate an alarm signal if the count value is greater than or equal to a predetermined first count value and less than a second predetermined count value. Annunciator means, responsive to the alarm signal, is operative to indicate an alarm condition if the alarm signal is generated.

The pulse width discriminator is further operative to generate a wide signal if the crest signal remains active for a third predetermined time interval. Wind condition detection circuitry is responsive to the wide signal and the count value, and is operative to generate a wind warning signal if the wide signal is active and the count value is less than a predetermined wind count value. The alarm condition detection circuitry is further responsive to the wind signal, and further operative to hold the alarm signal inactive if the wind signal is active. The annunciator means is further responsive to the wind signal and further operative to indicate a wind warning condition if the wind signal is active.

A switch is provided, the switch being operative to generate a closure signal in response to a closure of the switch. An ON/OFF control circuit, responsive to the closure signal, is operative to generate a system status signal indicative of whether the wave motion detector system is currently operating in an armed mode or in a disarmed mode. The alarm condition detection circuitry is responsive to the system status signal, and operative to hold the alarm signal inactive if the wave motion detector system is currently disarmed. The wind condition detection circuitry is responsive to the system status signal, and operative to hold the wind signal inactive if the wave motion detector system is currently disarmed.

The ON/OFF control circuit further includes logic circuitry responsive to the closure signal, and operative to maintain operation of the wave motion detection system in the armed mode except in response to: a first activation of the closure signal, which triggers the beginning of a first disarm time interval, and of a second disarm time interval; a second activation of the closure signal after the first disarm time interval has elapsed; and a third activation of the closure signal after the second activation of the closure signal and before the second disarm time interval has elapsed.

The ON/OFF control circuit is responsive to the count value and the system status signal, and operative to cause the wave motion detection system to switch from the disarmed mode to the armed mode if the system status signal indicates that the system is disarmed and the count value does not reach a count of two during a dormancy interval.

An important advantage of the present invention is that it will detect, within moments, the unauthorized entrance of an animal or small child into a swimming pool or spa.

Another advantage of the present invention is that false alarms due to wind gusts or other false disturbances are greatly reduced due to the ability to distinguish between disturbances of the type caused by a child or animal, and those caused by wind, rain or usual pool side traffic.

A further advantage of the pool alarm system of the present invention is that it automatically turns on after a fixed period of time during which no one is swimming in the pool.

Yet another advantage of the pool alarm system of the present invention is that it remains armed until it is disarmed according to a child-proof deactivation procedure.

IN THE DRAWING

FIG. 7A is a detailed schematic diagram of a frequency generating sub-circuit of the synthesizer of FIG. 6;

DETAILED DESCRIPTION OF THE PREFERRED EMBODIMENTS

Figure 1:
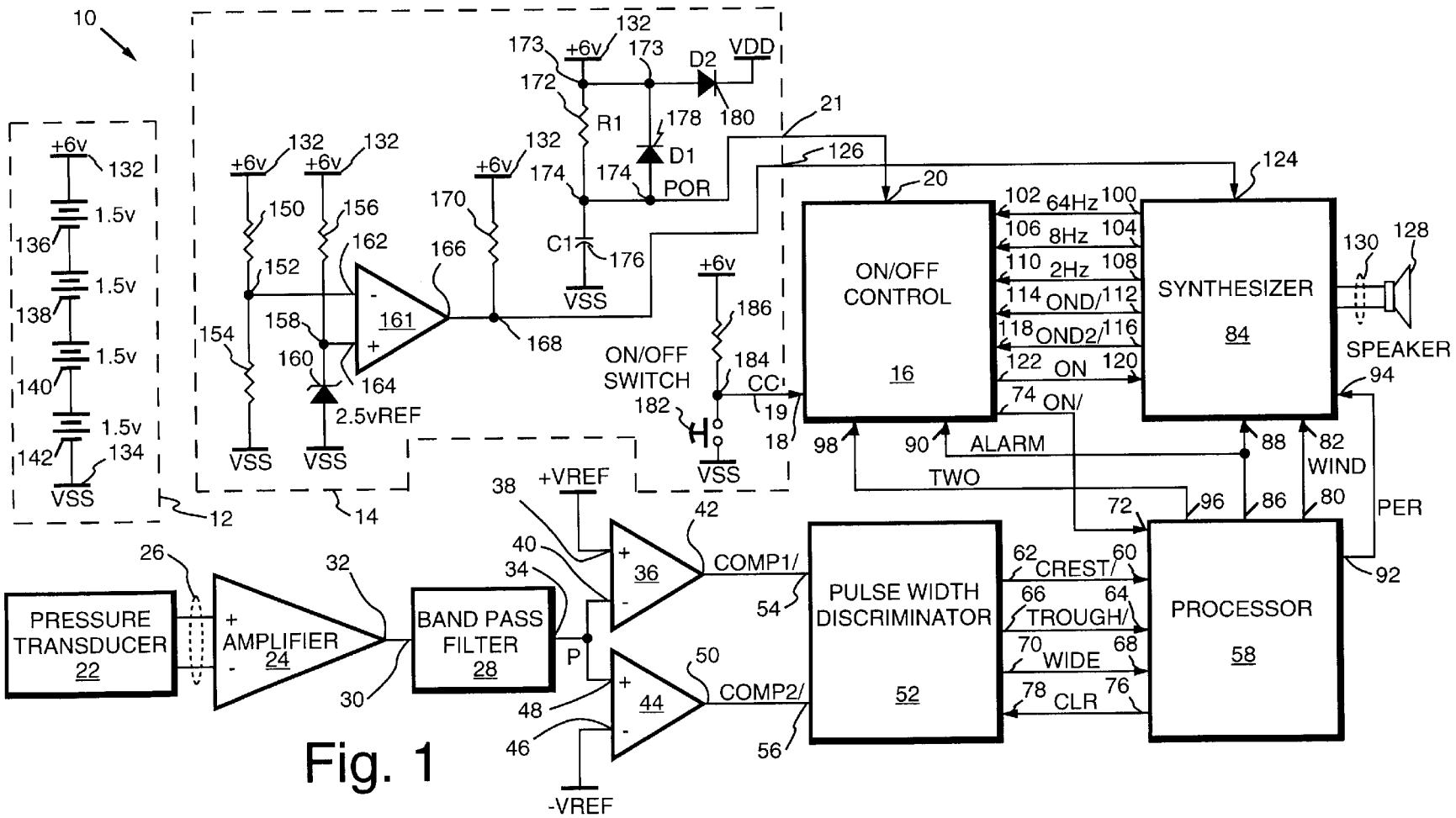
FIG. 1 is a generalized schematic circuit block diagram of a pool alarm system according to the present invention including a pulse width discriminator, a processor, an ON/OFF control circuit, and a synthesizer.

FIG. 1 shows a schematic circuit block diagram of a swimming pool alarm system at 10 in accordance with the present invention. The alarm system 10 includes: a battery power supply 12; a supply voltage monitor circuit 14; and an ON/OFF control unit 16 having an input 18 coupled to receive a contact signal (CC signal) from an output 19 of the supply voltage monitor circuit 14, and an input 20 coupled to receive a power on reset signal (POR signal) from an output 21 of the voltage monitor circuit.

The alarm system at 10 also includes: a pressure transducer 22, placed in the water of a swimming pool; an amplifier 24 having an input port coupled to receive a transducer output signal from the pressure transducer 22 via transducer signal lines 26; a band pass filter 28 having an input 30 coupled to receive an amplified transducer signal from an output 32 of the amplifier 24, and an output 34; a first comparator 36 having a positive input 38 connected to a positive reference voltage supply +VREF, a negative input 40 coupled to receive a pressure signal from the output 34 of the band pass filter 28, and an output 42 providing a first inverted comparator signal (inverted COMP1/ signal); and a second comparator 44 having a negative input 46 connected to a negative voltage reference supply −VREF, a positive input 48 coupled to receive the pressure signal from the output 34 of the band pass filter, and an output 50 providing a second inverted comparator signal (inverted COMP2/ signal).

In the preferred embodiment of the present invention, the pressure transducer 22 is a sub-surface pressure sensor. In an alternative embodiment, the pressure transducer is a surface depth sensor. The band pass filter 20 attenuates frequencies above 2 Hz and below 1 Hz at 60 dB per decade. The gains of the amplifier 24 and filter 28 are scaled such that a predefined threshold pressure applied to the transducer 22 of approximately 5×10−4 psi will cause the voltage of the pressure signal generated at the output 34 of the filter 28 to be equal to +VREF (for positive water pressure) or −VREF (for negative water pressure). In the present invention, the amplifier 24 is adapted to provide a gain varying with the output voltage signal of the transducer 22 used. The transducer currently preferred is a 24PCEFA2G manufactured by the Micro Switch division of Honeywell Inc. The specified output voltage for an input pressure of 0.5 psi and an excitation voltage of 10 V is 35 mV typical. With the threshold voltages (+VREF and −VREF) set to 50 mV, and the excitation voltage set to 1 V to conserve battery power, the transducer output is 3.5 uV typical for an input pressure of 0.0005 psi. The voltage gain required for the amplifier/filter combination is thus 14,286 at 1 Hz. The excitation voltage is adjustable to compensate for unit to unit variations in transducer sensitivity and voltage gain. In response to a positive pressure in excess of 5×10−4 psi, transducer 22 is operative to generate a signal level which, when amplified by amplifier 24 and filtered by filter 28, is equal to +VREF which causes the inverted COMP1/ signal provided at the output 42 of the first comparator to transition to a logical low voltage (transition LO). In response to a negative pressure in excess of 5×10−4 psi, transducer 22 generates a signal level which, when amplified by amplifier 24 and filtered by filter 28, is equal to −VREF which causes the inverted COMP2/ signal provided at the output 50 of the second comparator to transition LO, as further described below.

The alarm system at 10 further includes a pulse width discriminator 52 having a first input 54 coupled to receive the inverted COMP1/ signal from the output 42 of the first comparator, and a second input 56 coupled to receive the second inverted comparator COMP2/ from the output 50 of the second comparator.

A processor 58 includes: an input 60 coupled to receive an inverted CREST/ signal (indicative of qualified positive increases in water pressure, qualified crests, sensed by the transducer 22) from a first output 62 of the pulse width discriminator; an input 64 coupled to receive an inverted TROUGH/ signal (indicative of qualified increases in negative water pressure, qualified troughs, sensed by the transducer 22) from a second output 66 of the pulse width discriminator; an input 68 coupled to receive a WIDE signal,(indicative of an increase in positive water pressure which is sustained for a long period enough to suggest that it is the result of a swell caused by a gust of wind) from a third output 70 of the pulse width discriminator; and an input 72 coupled to receive an inverted system status signal (ON/ signal) from an output 74 of the ON/OFF control unit 16. The processor 66 also includes a set of outputs having: an output 76 coupled to provide a clear signal (CLR signal) to an input 78 of the pulse width discriminator; an output 80 coupled to provide a WIND signal to an input 82 of a synthesizer 84; an output 86 coupled to provide an ALARM signal to an input 88 of the synthesizer 84 and to an input 90 of the ON/OFF control unit 16; an output 92 coupled to provide a periodic warning signal (PER signal) to an input 94 of the synthesizer; and an output 96 coupled to provide a count-two signal TWO (TWO signal) to an input 98 of the ON/OFF control unit 16.

The synthesizer 84 includes: an output 100 coupled to provide a 64 Hz signal to an input 102 of the ON/OFF control unit 16; an output 104 coupled to provide an 8 Hz signal to an input 106 of the ON/OFF control unit; an output 108 coupled to provide a 2 Hz signal to an input 110 of the ON/OFF control unit; an output 112 coupled to provide an OND/ signal to an input 114 of the control unit 16; and output 116 coupled to provide an inverted OND2/ signal to an input 118 of the ON/OFF control unit; an input 120 coupled to receive a system status signal (ON signal) from an output 122 of the ON/OFF control unit; and an input 124 coupled to receive a low battery signal (LOBAT signal) from an output 126 of the supply voltage monitor circuit 14. A speaker 128 is coupled to receive a synthesizer output signal from synthesizer 84 via synthesizer output signal lines 130.

The power supply 12 includes a high voltage rail 132; a low voltage rail 134 (VSS); and four 1.5 volt batteries 136, 138, 140, and 142 coupled in series between the high voltage rail 132 and the low voltage rail 134. When the batteries are fully charged, the potential provided between the rail 132 and rail 134 (VSS) is +6V. The voltage monitor circuit 14 includes: a first resistor 150 having a first terminal connected to rail 132, and a second terminal coupled to a first node 152; a second resistor 154 having a first terminal coupled to node 152, and a second terminal coupled to VSS; a third resistor 156 having a first terminal coupled to rail 132, and a second terminal coupled to node 158; a diode 160 having an anode coupled to VSS, and a cathode coupled to the node 158; a third comparator 161 having a negative input 162 coupled to node 152, a positive input 164 coupled to node 158, and an output 166 coupled to a third node 168; a fourth resistor 170 having a first terminal coupled to rail 132, and a second terminal coupled to node 168; a fifth resistor 172 having a first terminal coupled to a fourth node 173 which is connected to rail 132, and a second terminal coupled to a fifth node 174; a capacitor 176 (C1) having a first terminal coupled to node 174, and a second terminal coupled to VSS; a first diode 178 (D1) having an anode coupled to node 174, and a cathode coupled to node 173; and a second diode 180 (D2) having an anode coupled to the fourth node 173, and a cathode coupled to a system supply voltage source VDD.

When the battery voltage across rails 132 and 134 (VSS) drops to approximately 5V, the output of the third comparator 161 transitions to a logical high voltage level (transitions HI), and the LOBAT signal provided at output 126 of the monitor circuit 14 transitions HI. The fifth resistor 172, capacitor 176, and first diode 178 POR ensure that the pool alarm system 10 will be "OFF" when batteries 136–142 are installed.

The second diode 180 prevents damage to digital circuitry of the ON/OFF control circuit 16, discriminator 52, processor 58, and synthesizer 84 in the event that the batteries 136, 138, 140, and 142 are installed wrong. A contact closure between node 184 and VSS activates the contact signal CC which is used for arming and disarming the pool alarm system 10 as further explained below.

Figure 2:
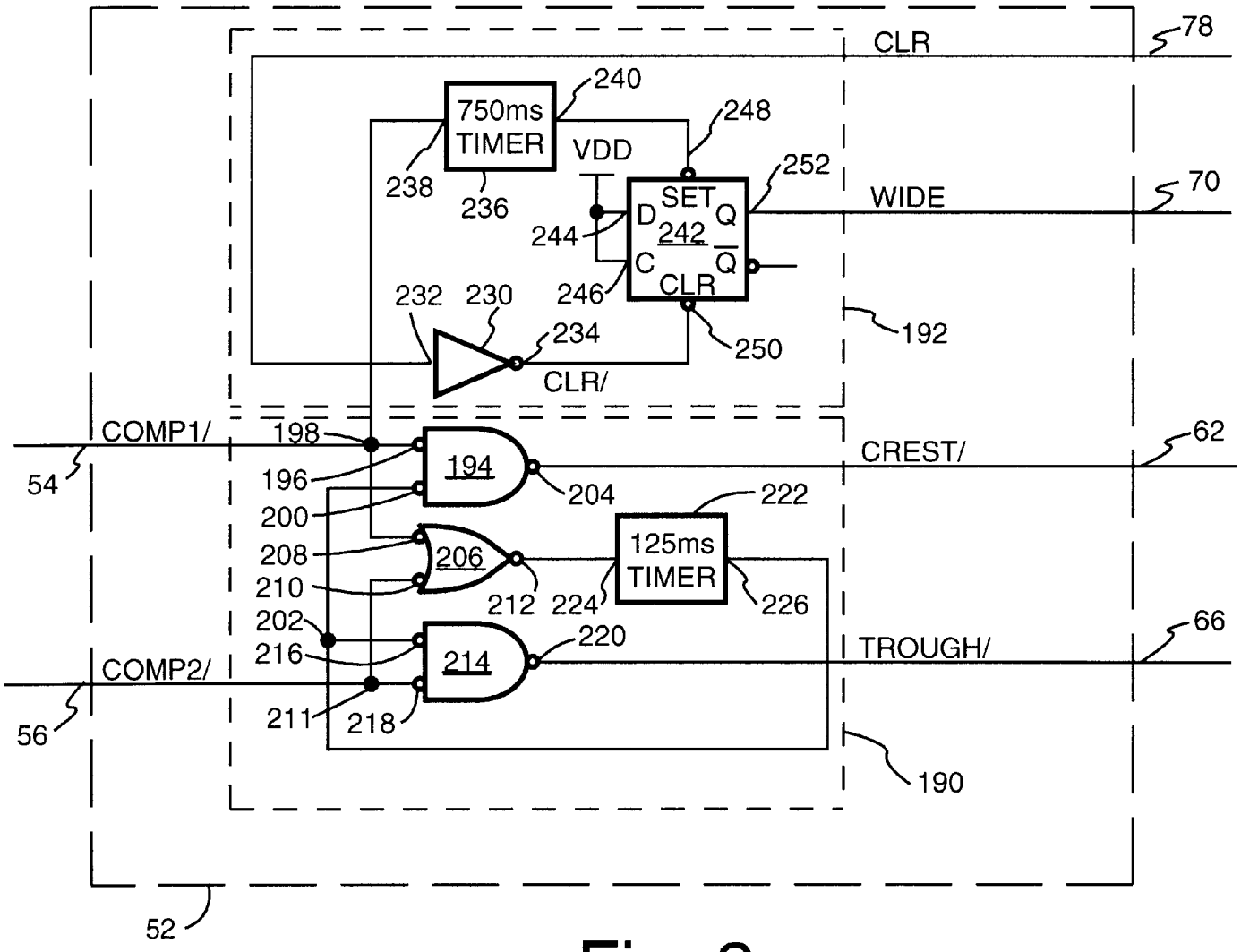
FIG. 2 is a detailed schematic circuit diagram of the pulse width discriminator of FIG. 1.

FIG. 2 is a schematic circuit diagram of the pulse width discriminator 52 which includes a first wave qualification circuit 190 for detecting qualified wave crests and qualified wave troughs which are suggestive of wave motion caused by the entry of a small child or animal into the swimming pool, and a second wave qualification circuit 192 for detecting wave crests having a sufficient width to be suggestive of a swell caused by a gust of wind incident on the pool.

The first wave qualification circuit 190 includes: an AND gate 194 having a first inverted input 196 connected to receive a wave qualification timer signal via a node 198 which is coupled to receive the inverted COMP1/ signal via input 54 of the discriminator 52, a second inverted input 200 connected to a node 202, and an inverted output 204; an OR gate 206 having a first inverted input 208 connected to receive the inverted COMP1/ signal via the node 198, a second inverted input 210 connected to receive the inverted COMP2/ signal via a node 211 which is connected to input 56 of the pulse width discriminator, and an inverted output 212 providing a qualified timer enable signal; an AND gate 214 including a first inverted input 216 connected to receive the wave qualification timer signal via node 202, a second inverted input 218 connected to receive the inverted COMP2/ signal via node 211, and an inverted output 220; a wave qualification timer circuit 222 having an enable input 224 coupled to receive the timer enable signal from the inverted output 212 of gate 206, and an output 226 coupled to provide the wave qualification timer signal to the node 202. In the preferred embodiment, the qualification timer 222 is a 125 ms timer circuit and the qualification timer signal provided at its output 226 transitions to a LO state 125 ms after the timer enable signal received at its enable input 238 transitions to the LO state provided that the timer enable signal does not transition to a HI state in the interim.

The second wave qualification circuit 192 includes: an inverter gate 230 having an input 232 coupled to receive the CLR signal from processor 58 (FIG. 1) via input 78 of the pulse width discriminator, and an output 234 providing an inverted clear signal (inverted CLR/ signal); a crest width timer 236 having an enable input 238 coupled to receive the inverted COMP1/ signal via node 198, and an output 240 providing a crest width timer signal; a flip-flop 242 having a data input 244 and a clock input 246 both connected to VDD, an inverted asynchronous set input 248 coupled to receive the crest width timer signal from output 240 of timer 236, an inverted asynchronous clear input 250 connected to receive the inverted CLR/ signal from the output 234 of gate 230, and an output 252 coupled to provide the WIDE signal to output 70 of the pulse width discriminator. In the preferred embodiment, timer 236 is a 750 ms timer circuit and the crest width timer signal provided at its output 240 transitions LO 750 ms after the inverted COMP1/ signal, received at its enable input 238, transitions LO provided that the inverted COMP1/ signal does not transition to a HI state in the interim.

In operation of the first wave qualification circuit 190, if either of the first or second inverted comparator signals (inverted COMP1/ or COMP2/ signals) provided by the first and second comparators 36 and 44 (FIG. 1) transitions LO, the wave qualification timer 222 is enabled by the timer enable signal received at enable input 224 via gate 206. If timer 222 is enabled by the inverted COMP1/ signal switching LO, and if the first inverted comparator signal remains LO for at least 125 ms, the output 226 of timer 222 provides a LO pulse to the input 196 of gate 194, and the inverted CREST/ signal provided at output 204 of gate 194 will transition LO. A transition of the inverted CREST/ signal to the LO state indicates the detection of a qualified wave crest by transducer 22 (FIG. 1). A qualified wave crest is defined as an increase in positive pressure sensed by the transducer beyond the predefined positive threshold which is sustained for at least 125 ms.

If timer 222 is enabled by the inverted COMP2/ signal transitioning LO, and if the inverted COMP2/ signal remains LO for at least 125 ms, the output 226 of timer 222 will provide a LO pulse to input 216 of gate 214 causing the inverted TROUGH/ signal provided at output 220 of gate 214 to transition LO. A transition of the inverted TROUGH/ signal to the LO state indicates the detection of a qualified wave trough by transducer 22 (FIG. 1). A qualified wave trough is defined as an increase in negative pressure sensed by the transducer beyond the predefined negative threshold which is sustained for at least 125 ms.

In operation of the second wave qualification circuit 192, if the inverted COMP1/ signal transitions LO and remains LO for as long as 750 ms, the output 240 of timer 236 sets flip-flop 242 via the asynchronous set input 248 causing the WIDE signal provided at output 252 of flip-flop 242 to transition HI. Therefore, a transition HI of the WIDE signal indicates an increase in positive pressure sensed by transducer 22 (FIG. 1) beyond the predefined threshold which is sustained for at least 750 ms. Flip-flop 24 may be cleared via the inverted CLR/ signal provided by inverter 230 as further explained below.

Figure 3:
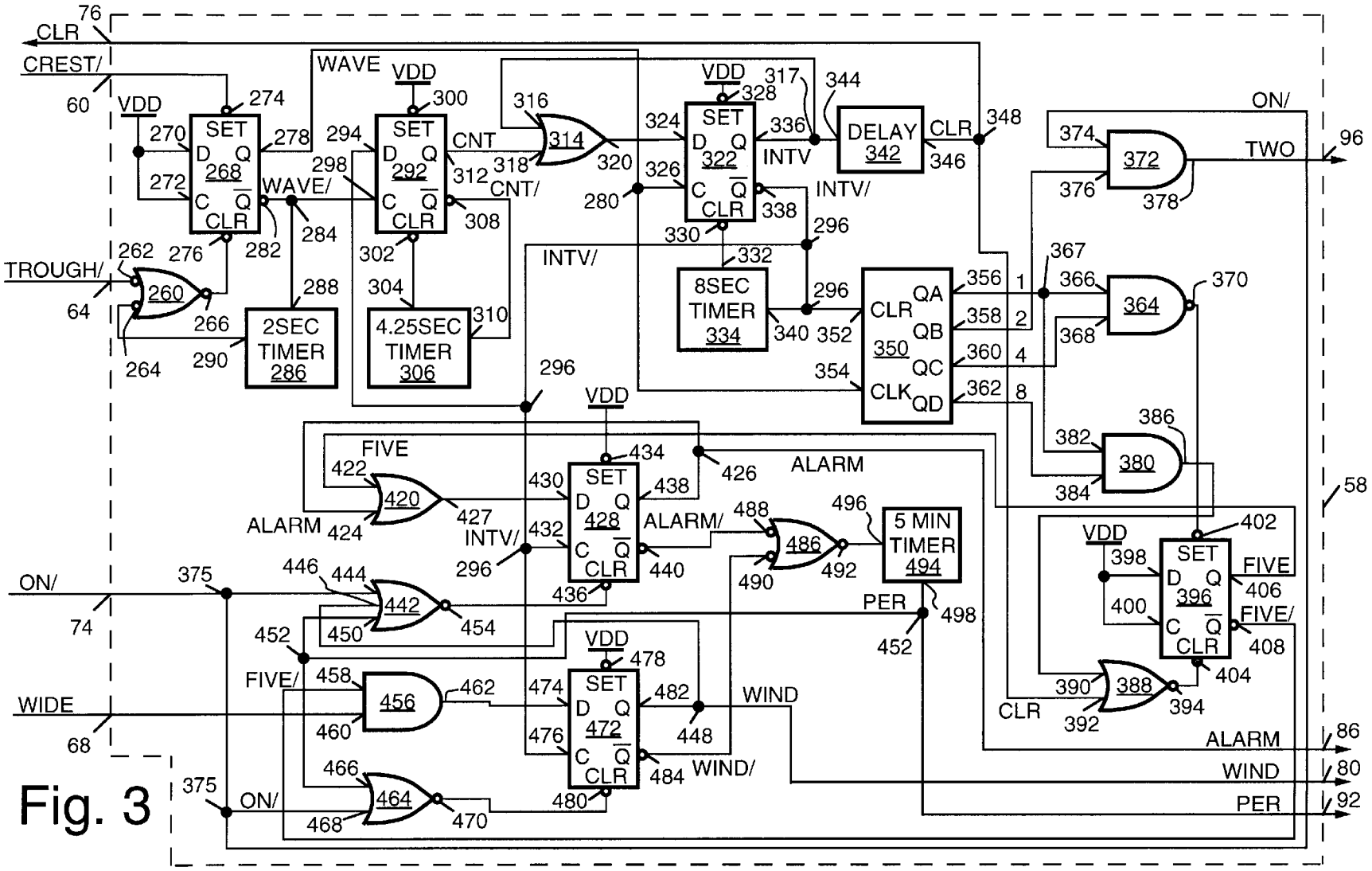
FIG. 3 is a detailed schematic circuit diagram of the processor of FIG. 1.

FIG. 3 shows a detailed schematic circuit diagram of processor 58 (FIG. 1) which includes: an OR gate 260 including an inverted input 262 coupled to receive the inverted TROUGH/ signal via input 64 of processor 58, an inverted input 264, and an inverted output 266; a first flip-flop 268 including a data input 270 and a clock input 272 both coupled to VDD, an inverted asynchronous set input 274 coupled to receive the inverted CREST/ signal via input 60 of the processor, an inverted asynchronous clear input 276 connected to the inverted output 266 of gate 260, an output 278 coupled to provide a WAVE signal to a node 280, and an inverted output 282 coupled to provide an inverted WAVE/ signal to a node 284; a first timer circuit 286 having an enable input 288 activated by a logical low voltage level (LO) and coupled to receive the inverted WAVE/ signal via node 284, and an output 290 coupled to provide a first timer signal to the input 264 of the gate 260; a second flip-flop 292 having a data input 294 coupled to receive an inverted count interval signal (INTV/ signal) via a node 296, a clock input 298 connected to receive the inverted WAVE/ signal via node 284, an inverted asynchronous set input 300 connected to VDD, an inverted asynchronous clear input 302 connected to an output 304 of a second timer circuit 306, an inverted output 308 coupled to provide an inverted count enable signal (inverted CNT/ signal) to an enable input 310 of timer circuit 306, and an output 312 providing a count enable signal (CNT signal); and an OR gate 314 having an input 316 connected to a node 317, an input 318 coupled to receive the CNT signal from output 312 of flip-flop 292, and an output 320.

The depicted processor also includes: a third flip-flop 322 having a data input 324 connected to the output 320 of the OR gate 314, a clock input 326 connected to receive the WAVE signal via node 280, an inverted asynchronous set input 328 connected to the VDD, an inverted asynchronous clear input 330 connected to an output 332 of a count interval timer circuit 334, an output 336 providing a count interval signal (INTV signal), and an inverted output 338 providing the inverted INTV/ signal to node 296; a third timer 334 having an input 340 coupled to receive the inverted INTV/ signal from the inverted output 338 of flip-flop 322 via node 296; a delay unit 342 includes an input 344 connected to receive the INTV signal via node 317, and an output 346 connected to provide the CLR signal to output 76 of processor 58 via a node 348.

The processor 58 further includes: a four bit counter 350 for storing a count value and having a clear input 352 connected to receive the inverted INTV/ signal via node 296, an inverted clock input 354 connected to receive the WAVE signal from output 278 of flip-flop 268 via node 280, a first output 356 providing a first count bit signal, a second output 358 providing a second count bit signal, a third output 360 providing a third count bit signal, and a fourth output 362 providing a fourth count bit signal representing the most significant count bit of the count value; a NAND gate 364 having an input 366 connected to receive the first count bit signal from output 356 of the counter via a node 367, an input 368 connected to receive the third count bit signal from output 360 of the counter, and an output 370; an AND gate 372 having an input 374 coupled to receive the inverted ON/ signal from input 74 of the processor via a node 375, an input 376 connected to receive the second count bit signal from output 358 of the counter, and an output 378 coupled to provide the TWO signal to output 96 of the processor; an AND gate 380 having an input 382 connected to receive the first count bit signal from output 356 of counter 350 via node 367, an input 384 connected to receive the fourth count bit signal from output 362 of the counter, and an output 386; and a NOR gate 388 having an input 390 connected to output 386 of AND gate 380, an input 392 connected to receive the CLR signal via node 348, and an output 394.

The processor 58 further includes: a fourth flip-flop 396 having a data input 398 and a clock input 400 both connected to VDD, an inverted asynchronous set input 402 connected to output 370 of NAND gate 364, an inverted asynchronous clear input 404 connected to output 394 of NOR gate 388, an output 406 providing a count-five signal (FIVE signal), and an inverted output 408 providing an inverted count-five signal (inverted FIVE/ signal); an OR gate 420 having an input 422 connected to receive the FIVE signal from output 406 of flip-flop 396, an input 424 connected to receive the ALARM signal via a node 426, and an output 427; a fifth flip-flop 428 having a data input 430 connected to output 427 of OR gate 420, a clock input 432 connected to receive the inverted INTV/ signal via node 296, an inverted asynchronous set input 434 connected to VDD, an inverted asynchronous clear input 436, an output 438 providing the ALARM signal to node 426, and an inverted output 440 providing an inverted ALARM/ signal; a NOR gate 442 having an input 444 connected to receive the ON/ signal via node 375, an input 446 connected to receive the WIND signal via a node 448, an input 450 connected to receive the PER signal via a node 452, and an output 454 connected to the asynchronous clear input 436 of flip-flop 428; an AND gate 456 having an input 458 connected to receive the inverted FIVE/ signal from inverted output 408 of flip-flop 396, an input 460 coupled to receive the WIDE signal from input 68 of processor 58, and an output 462; a NOR gate 464 having an input 466 connected to receive the PER signal via node 452, an input 468 connected to receive the inverted ON/ signal via node 375, and an output 470; a sixth flip-flop 472 having a data input 474 connected to the output 462 of AND gate 456, a clock input 476 connected to receive the inverted INTV/ signal via node 296, an inverted asynchronous set input 478 connected to VDD, an inverted asynchronous clear input 480 connected to output 470 of NOR gate 464, an output 482 connected to provide the WIND signal to output 80 of the processor via node 448, and an inverted output 484 providing an inverted WIND/ signal; an OR gate 486 having an inverted input 488 connected to receive the inverted ALARM/ signal from inverted output 440 of flip-flop 428, an inverted input 490 connected to receive the inverted WIND/ signal from inverted output 484 of flip-flop 472, and an inverted output 492; and a periodic warning timer circuit 494 having an enable input 496 activated by a LO voltage level and connected to the inverted output 492 of gate 486, and an output 498 connected to provide the PER signal to node 452.

In the preferred embodiment of the present invention: the first timer circuit 286 is a two second timer circuit; the second timer circuit 306 is a 4.25 second timer circuit; the count interval timer circuit 334 is an 8 second timer circuit; and the periodic warning timer circuit 494 is a five minute timer circuit. Each of these timer circuits is activated by application of a logical low voltage level at its input and provides a logical low voltage level at its output upon being activated. Each of the inverted asynchronous set and clear inputs of each of the flip-flops 268, 292, 322, 396, 428, and 472 responds to DC levels and is operated independently of the respective synchronous data inputs and clock inputs of the flip-flops. For each of the flip-flop circuits, assuming that the asynchronous set and clear inputs are both in the HI state, the flip-flop responds to the data inputs. If the inverted asynchronous clear input is subsequently pulsed LO, the flip-flop is cleared. If the inverted asynchronous set input is subsequently pulsed LO, the flip-flop is set.

In operation of processor 58, flip-flop 268 is: (1) set by a transition to the LO state of the inverted CREST/ signal received at its asynchronous set input 274, and (2) cleared by a transition to the LO state of the inverted TROUGH/ signal received at its asynchronous clear input 276 via gate 260. Therefore, the WAVE signal provided at output 278 switches as flip-flop 268 is set and cleared by qualified wave crests and troughs which are detected by transducer 22 (FIG. 1) and qualified by discriminator 52. The first timer 286 is: (1) enabled when the inverted WAVE/ signal transitions LO (when flip-flop 268 is set); and (2) disabled when the inverted WAVE/ signal transitions HI (when flip-flop 268 is cleared). If the inverted TROUGH/ signal does not transition LO within 2 seconds of a transition to the LO state of the inverted CREST/ signal, the timer circuit 286 automatically clears flip-flop 268 two seconds after it is set.

When flip-flop 292 is set, the CNT signal provided at its output 312 transitions HI. Flip-flop 292 is set by a transition to the HI state of the inverted WAVE/ signal received at its clock input 298 (when flip-flop 268 is set) if the inverted INTV/ signal, received at its data input 294, is LO (if flip-flop 322 is also cleared). Therefore, flip-flop 292 is set by the detection of a qualified wave crest if processor 58 is not currently operating in a count interval as explained further below. Flip-flop 292 is cleared by transition to the HI state of the inverted WAVE/ signal if the inverted INTV/ signal is HI. If flip-flop 292 is not cleared within 4.25 seconds of being set, it is automatically cleared by timer 306 which is enabled when the inverted CNT/ signal received at its enable input 310 transitions LO.

Flip-flop 322, which provides the INTV signal at its output 336, is set by a transition to the HI state of the WAVE signal (received at its clock input 326) if the CNT signal received at its data input 324, via gate 314, is HI. The data input 324 of flip-flop 322 is held HI independent of the CNT signal by the INTV signal received at input 316 of OR gate 314 for as long as the count interval signal INTV is HI. Flip-flop 322 is cleared by the count interval timer 334 a predetermined time interval after timer 334 is enabled. Approximately 1 ms after flip-flop 322 is cleared, the CLR signal provided by output 346 of delay unit 342 pulses HI. The function of the CLR signal is further described below. Timer 334 is set when the INTV signal transitions HI. In the preferred embodiment, timer 334 is an 8 second timer circuit and the signal generated at its output 332 (and provided to the asynchronous clear input 330 of flip-flop 322) transitions LO eight seconds after counter 334 is enabled. Therefore, the INTV signal remains HI for 8 seconds after flip-flop 322 is set.

The four bit counter 350 is enabled by inverted INTV/ signal received at its clear input 352 from output 338 of flip-flop 322. Counter 350 stores a count value which is increased each time the WAVE signal received at its inverted clock input 354 transitions LO. Therefore, during the 8 second period for which flip-flop 322 is set (and the INTV signal is HI), counter 350 is enabled to count the number of negative transitions of the WAVE signal, thereby counting the number of qualified wave crests and troughs detected by transducer 22 (FIG. 1) during the 8 second count interval.

If the count value of counter 350 reaches two (0010), and the pool alarm system is disarmed (the inverted ON/ signal is HI), the second count bit signal provided at output 358 of the counter transitions HI, and the count-two signal (TWO signal) generated at output 378 of AND gate 372 pulses HI. Therefore, the TWO signal is pulsed upon the detection of two qualified waves provided that the pool alarm system 10 (FIG. 1) is currently disarmed. The TWO signal, which is receive at input 98 of the ON/OFF circuit 16 (FIG. 1), is used to set a timer while the system is disarmed and if two qualified waves are not detected for a predetermined time interval, the alarm system is automatically armed, as further explained below.

If the count value of counter 350 reaches a count of five (0101), the first and third count bit signals provided by outputs 356 and 360 of counter 350 are both HI, and flip-flop 396 is set via NAND gate 364 causing the FIVE signal to transition HI. If the count value reaches a count of nine (1001), the first and fourth count bit signals provided at outputs 356 and 362 are both HI, and flip-flop 396 is cleared via gates 380 and 388. If flip-flop 396 is not cleared by the count value reaching nine (1001), it is cleared by the CLR signal provided to the asynchronous clear input 404 of flip-flop 396 via gate 388.

Unless flip-flop 428 is held cleared by a LO voltage applied to its asynchronous clear input 436, flip-flop 428 is set in response to the FIVE signal, received at its data input 430 via gate 420, being HI when the inverted INTV/ signal, received at its clock input 432, transitions from LO to HI. If flip-flop 396 is set (the FIVE signal is HI) when flip-flop 322 is cleared (at the end of the 8 second count interval), the data input 430 of flip-flop 428 will be held HI via gate 420 while the inverted INTV/ signal transitions LO. Flip-flop 428 is set, and the ALARM signal provided at its output 438 is HI, if: (1) the count value stored in counter 350 is greater than or equal to five and less than nine at the end of the eight second count interval; (2) the alarm system is armed (the inverted ON/ signal is LO); and (3) the WIND signal is LO. The count value is greater than or equal to five and less than nine at the end of the eight second interval if flip-flop 396 is set when flip-flop 322 is cleared. If the pool alarm system is disarmed (the inverted ON/ signal is HI) or if the WIND signal is HI, flip-flop 428 will be held LO by the output of gate 442.

When flip-flop 428 is set, the periodic warning timer circuit 494 is enabled by the inverted ALARM/ signal received from output 440 of flip-flop 428 via gate 486. Five minutes later, flip-flop 428 is cleared by a timer signal provided to the inverted asynchronous clear input 436 of flip-flop 428 via gate 442.

If the WIDE signal is HI (a wave crest wider than 750 ms has been detected by the transducer indicating that a gust of wind is incident on the pool), and the inverted FIVE/ signal is HI, (the count value is less than five), the data input 474 of flip-flop 472 is held HI by AND gate 456 and the rising edge of the inverted INTV/ signal, received at its clock input 476, will set flip-flop 472 causing the WIND signal provided at output 482 of flip-flop 472 to transition HI.

The WIND signal is set at the end of the count interval if: (1) a wave crest having a width greater than 750 ms has been detected by the pulse width discriminator (the WIDE signal is HI); and (2) the count value stored in counter 350 is less than five. If the alarm system 10 (FIG. 1) is disarmed (the inverted ON/ signal is HI), flip-flop 472 will be held cleared, and the WIND signal provided at output 482 of flip-flop 472 will be held LO by gate 464 even if a "wide wave crest" is detected and the count value is less than five. If flip-flop 472 is set, timer 494 will be enabled via gate 486 and five minutes later, flip-flop 472 will be cleared via gate 464.

Figure 4:
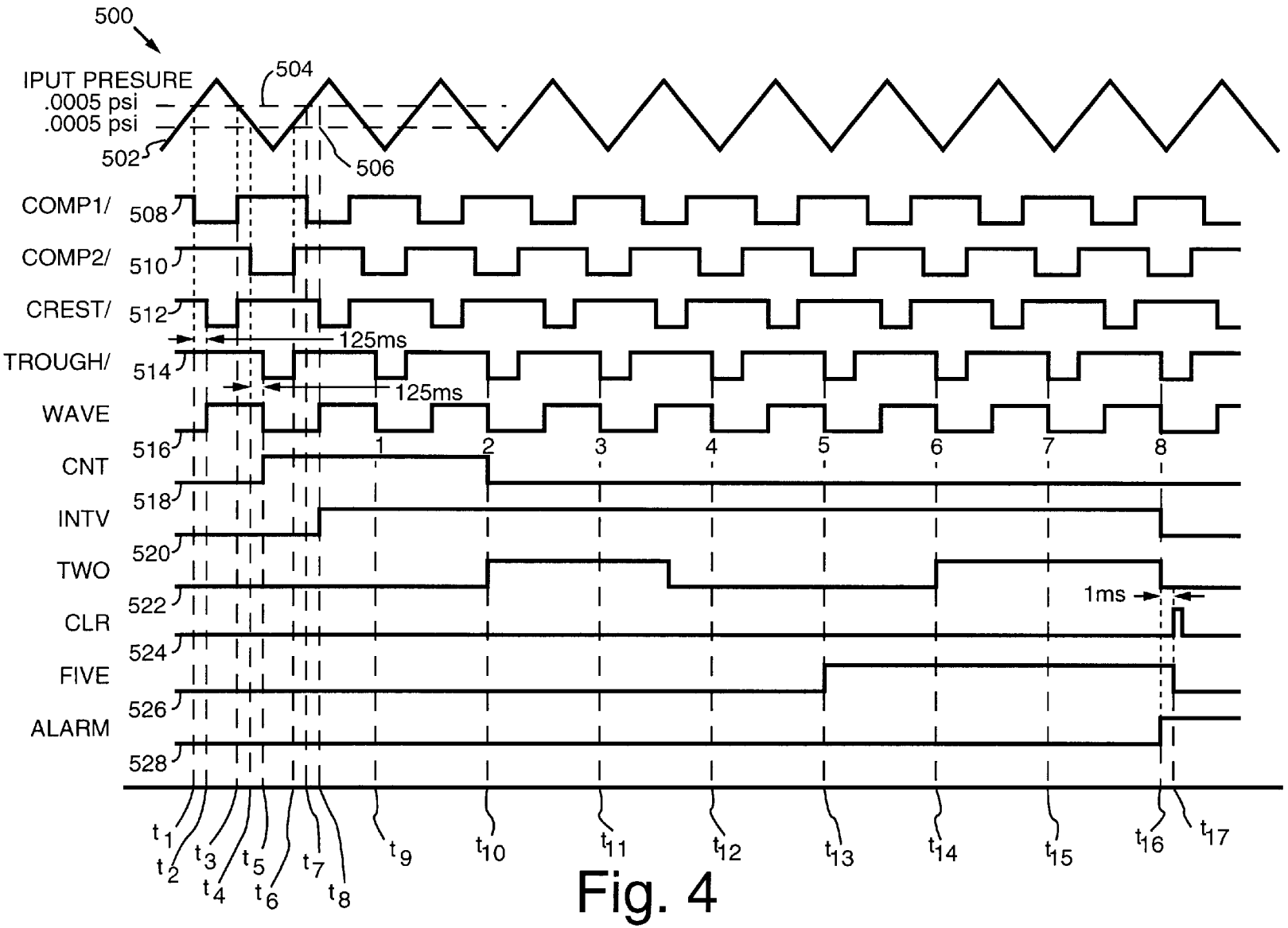
FIG. 4 is a timing diagram illustrating operation of the pulse width discriminator and processor of the pool alarm system of FIGS. 1, 2, and 3 in response to a small child or animal entering the pool.

FIG. 4 shows a timing diagram at 500 illustrating the timing of data signals and processing signals for operation of the pulse width discriminator 52 and processor 58 of FIG. 1. The diagram includes a wave form 502 representing the pressure sensed by the pressure transducer 22 (FIG. 1) wherein the pressure level varies between the positive pressure threshold represented by the dashed line 504, and the negative pressure threshold represented by the dashed line 506. In the preferred embodiment, the positive pressure threshold has a value approximately equal to +0.0005 psi, and the negative pressure threshold has a value approximately equal to −0.0005 psi. Wave form 508 represents the inverted COMP1/ signal (FIG. 1), wave form 510 represents the inverted COMP2/ signal (FIG. 1), wave form 512 represents the inverted CREST/ signal (FIGS. 2 and 3), wave form 514 represents the inverted TROUGH/ signal (FIGS. 2 and 3), wave form 516 represents the WAVE signal (FIGS. 2 and 3), wave form 518 represents the CNT signal (FIG. 3), wave form 520 represents the INTV signal (FIG. 3), wave form 522 represents the TWO signal (FIG. 3), wave form 524 represents the CLR signal (FIGS. 2 and 3), wave form 526 represents the FIVE signal (FIG. 3), and wave form 528 represents the ALARM signal (FIG. 3).

At a time $t_1$, the water pressure (wave form 502) sensed by transducer 22 (FIG. 1) increases above the positive pressure threshold 504 causing the inverted COMP1/ signal (wave form 508) provided by first comparator 36 (FIG. 1) to transition from HI to LO. At a time $t_2$, approximately 125 ms after time $t_1$, the inverted CREST/ signal (wave form 512), provided by gate 194 (FIG. 2), transitions from HI to LO indicating that a qualified wave crest has been detected. The transition from HI to LO of the inverted CREST/ signal (wave form 512) sets flip-flop 268 (FIG. 3) of the processor thereby causing the WAVE signal (wave form 516) to transition from LO to HI. At a time $t_3$, the water pressure (wave form 502) decreases below threshold 504 causing the inverted COMP1/ signal (wave form 508) to transition from LO to HI which in turn causes the inverted CREST/ signal (wave form 512) provided by gate 194 (FIG. 2) to transition from LO to HI.

At a time $t_4$, the water pressure (wave form 502) sensed by the transducer decreases below the negative pressure threshold 506 causing the inverted COMP2/ signal (wave form 510), provided by the second comparator 44 (FIG. 1), to transition from HI to LO. At a time $t_5$, approximately 125 ms after time $t_4$, the inverted TROUGH/ signal (wave form 514), provided by gate 214 (FIG. 2) transitions from HI to LO in response to the inverted COMP2/ signal remaining in the LO state for the 125 ms measured by the wave qualification timer circuit 222 (FIG. 2) as explained above. Also at time $t_5$, the transition from HI to LO of the inverted TROUGH/ signal (wave form 514) clears flip-flop 268 (FIG. 3) thereby causing the WAVE signal (wave form 516), provided at output 278 of flip-flop 268, to transition from HI to LO. Further, at time $t_5$, the CNT signal (wave form 518), provided at output 312 of flip-flop 292 (FIG. 3), transitions from LO to HI as flip-flop 292 (FIG. 3) is set in response to the WAVE signal (wave form 516) transitioning from HI to LO while the INTV signal (wave form 520) is in the LO state, as explained above.

At a time $t_6$, the water pressure (wave form 502) increases above the negative threshold 506 causing the inverted COMP2/ signal provided by the second comparator 44 (FIG. 1) to transition from LO to HI which in turn causes the inverted TROUGH/ signal provided by gate 214 of the pulse width discriminator 52 (FIG. 2) to transition from LO to HI. At a time $t_7$, the water pressure (wave form 502) increases above the positive pressure threshold once again, causing the inverted COMP1/ signal (wave form 508) to transition from HI to LO. At a time $t_8$, 125 ms after time $t_7$, the inverted CREST/ signal (wave form 512) transitions from HI to LO, and the WAVE signal (wave form 516) transitions from LO to HI in the same manner as at time $t_2$. Also at time $t_8$, the INTV signal (wave form 520), provided at output 336 of flip-flop 322, transitions from LO to HI in response to the WAVE signal transitioning from LO to HI while the CNT signal (wave form 518) is in the HI state.

At time $t_8$, at which the counting interval is begun, the processor 58 (FIG. 3) begins counting qualified crests and troughs caused by disturbances in the pool. Between time $t_8$ and a time $t_9$, a qualified crest and a qualified wave trough are sequentially detected by the pulse width discriminator 52 (FIG. 1) which provides the inverted CREST/ and TROUGH/ signals which set and clear flip-flop 268 (FIG. 3) of the processor causing the WAVE signal (waveform 516) to transition from LO to HI and back to LO again. While the INTV signal (wave form 520) is HI, the counter 350 (FIG. 3) is enabled to count the number of HI to LO transitions of the WAVE signal (wave form 516) received at its inverted clock input 354. At time $t_9$, the count value stored in counter 350 (FIG. 3) is increased from zero to one, and at a time $t_{10}$, the count value increases from one to two causing the TWO signal (wave form 522) provided by gate 372 (FIG. 3) to transition from LO to HI indicating that two qualified waves have been detected during the count interval period. The count value stored in counter 350 (FIG. 3) is repeatedly increased by 1 at times $t_{11}$, $t_{12}$, $t_{13}$, $t_{14}$, $t_{15}$, and $t_{16}$ in response to detection of qualified crests and troughs as described above. At time $t_{13}$, the count value reaches five causing the FIVE signal (wave form 526) to transition from LO to HI indicating that five qualified waves have been detected during the count interval period. At time $t_{16}$, at which the count value reaches eight, the end of the count interval is reached and the INTV signal (wave form 520) transitions from HI to LO. Also at time $t_{16}$, flip-flop 428 (FIG. 3) is set, causing the ALARM signal (wave form 528) to transition from LO to HI, in response to the FIVE signal (wave form 526) being HI when the INTV signal (wave form 520) transitions from HI to LO. In this case, the flip-flop 428 (FIG. 3) is not held cleared by a LO voltage applied to its asynchronous clear input 480 (FIG. 3). At a time $t_{17}$, which is approximately 1 millisecond after time $t_{16}$, that is 1 millisecond after flip-flop 322 (FIG. 3) is cleared, the CLR signal provided by output 346 of delay unit 342 (FIG. 3) pulses HI.

Figure 5:
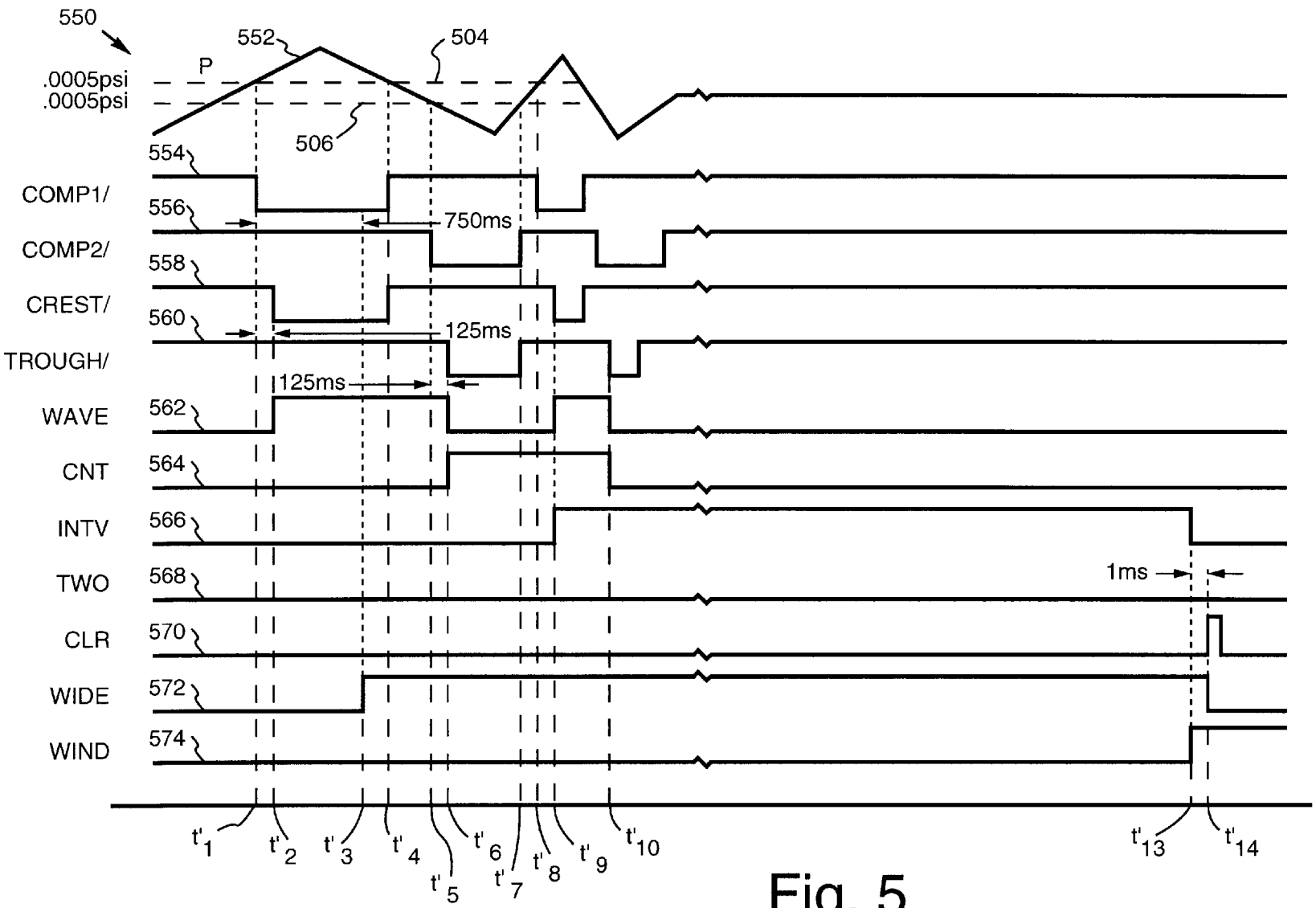
FIG. 5 is a timing diagram illustrating operation of the pulse width discriminator and processor of the pool alarm system of FIGS. 1, 2, and 3 in response to wave motion caused by wind forces incident on the pool.

FIG. 5 shows a timing diagram at 550 illustrating the timing of data signals and processing signals for operation of the pulse width discriminator 52 and processor 58 of FIG. 1. A wave form 552 represents variations in water pressure sensed by the pressure transducer 22 (FIG. 1) caused by wave motion induced in part by a gust of wind incidents on the pool. The remaining wave forms shown in FIG. 5 illustrate operation of the pulse width discriminator and processor in response to the variations in water pressure as represented by wave form 552. Wave form 556 represents the response of the inverted COMP1/ signal (FIG. 1) in response to wave form 552, wave form 558 represents the inverted COMP2/ signal in response to wave form 552, wave form 560 represents the inverted TROUGH/ signal, wave form 562 represents the WAVE signal, wave form 564 represents the CNT signal, wave form 566 represents the INTV signal, wave form 568 represents the TWO signal, wave form 570 represents the CLR signal, wave form 572 represents the WIDE signal, and wave form 574 represents the WIND signal.

At a time $t_1'$, the water pressure (wave form 552) sensed by transducer 22 (FIG. 1) increases above the positive pressure threshold 504 causing the inverted COMP 1/ signal (wave form 556) provided by first comparator 36 (FIG. 1) to transition from HI to LO. At a time $t_2'$, approximately 125 ms after time $t_1'$, the inverted CREST/ signal (wave form 568), provided by gate 194 (FIG. 2), transitions from HI to LO indicating that a qualified wave crest has been detected. The transition from HI to LO of the inverted CREST/ signal (wave form 568) sets flip-flop 268 (FIG. 3) of the processor thereby causing the WAVE signal (wave form 562) to transition from LO to HI. At a time $t_3'$, 750 ms after time $t_2'$, the inverted COMP1/ signal (wave form 554) is still LO because the pressure sensed by transducer 22 (FIG. 1) remains above the threshold, and timer 236 (FIG. 3) sets flip-flop 242 (FIG. 3) via its asynchronous set input causing the WIDE signal (wave form 574) provided at output 252 of flip-flop 242 (FIG. 3) to transition from LO to HI. At a time $t_4'$, the water pressure (wave form 552) decreases below threshold 504 causing the inverted COMP1/ signal (wave form 554) to transition from LO to HI which in turn causes the inverted CREST/ signal (wave form 558) provided by gate 194 (FIG. 2) to transition from LO to HI.

At a time $t_5'$, the water pressure (wave form 552) decreases below negative threshold 506 causing the inverted COMP2/ signal (wave form 556), provided by the second comparator 44 (FIG. 1), to transition from HI to LO. At a time $t_6'$, approximately 125 ms after time $t_5'$, the inverted TROUGH/ signal (wave form 560), provided by gate 214 (FIG. 2) transitions from HI to LO in response to the inverted COMP2/ signal remaining in the LO state for the 125 ms measured by the wave qualification timer circuit 222 (FIG. 2) as explained above. Also at time $t_6'$, the transition from HI to LO of the inverted TROUGH/ signal (wave form 560) clears flip-flop 268 (FIG. 3) causing the WAVE signal (wave form 562), provided at output 278 of flip-flop 268, to transition from HI to LO. Further, at time $t_6'$, the CNT signal (wave form 564) provided at output 312 of flip-flop 292 (FIG. 3) transitions from LO to HI as flip-flop 292 (FIG. 3) is set in response to the WAVE signal (wave form 516 of FIG. 4 or wave form 562 of FIG. 5) transitioning from HI to LO while the INTV signal (wave form 520) is in the LO state, as explained above.

At a time $t_7'$, the water pressure (wave form 552) increases above the negative threshold 506 causing the inverted COMP2/ signal (wave form 556) to transition from LO to HI which in turn causes the inverted TROUGH/ signal to transition from LO to HI. At a time $t_8'$, the water pressure (wave form 552) increases above the positive pressure threshold once again, causing the inverted COMP1/ signal (wave form 554) to transition from HI to LO. At a time $t_9'$, 125 ms after time $t_8'$, the inverted CREST/ signal (wave form 558) transitions from HI to LO, and the WAVE signal (wave form 562) transitions from LO to HI in the same manner as at time $t_2'$. Also at time $t_4'$, the INTV signal (wave form 566), provided at output 336 of flip-flop 322 (FIG. 3), transitions from LO to HI in response to the WAVE signal transitioning from LO to HI while the CNT signal (wave form 564) is in the HI state.

At a time $t_9'$, at which the counting interval is begun, the processor 58 (FIG. 3) begins counting qualified crests and troughs caused by disturbances in the pool. Between time $t_9'$, and a time $t_{10}'$, a qualified crest and a qualified wave trough are sequentially detected by the pulse width discriminator 52 (FIG. 1) which provides the inverted CREST/ and TROUGH/ signals which set and clear flip-flop 268 (FIG. 3) of the processor causing the WAVE signal (waveform 562) to transition from LO to HI and back to LO again. While the INTV signal (wave form 566) is HI, the counter 350 (FIG. 3) is enabled to count the number of HI to LO transitions of the WAVE signal (wave form 562) received at its inverted clock input 354. At time $t_{10}'$, the count value stored in counter 350 (FIG. 3) is increased from zero to one.

At a time $t_{13}'$, the count interval ends and the INTV signal (wave form 566) transitions from HI to LO. Also at time $t_{13}'$, the WIND signal (wave form 574) transition from LO to HI in response to the WIDE signal (wave form 572) being HI, indicating that a wave crest having a width greater than 750 ms has been detected by the pulse width discriminator, and the FIVE signal (not shown) being LO indicating that the count value stored in counter 350 (FIG. 3) is less than five. At a time $t_{14}'$, flip-flop 242 (FIG. 2) of the pulse width discriminator (FIG. 2) is cleared via the inverted CLR/ signal provided at its asynchronous clear input 250 and the WIDE signal (wave form 572), provided at output 252 of flip-flop 242, transition from HI to LO.

Figure 6:
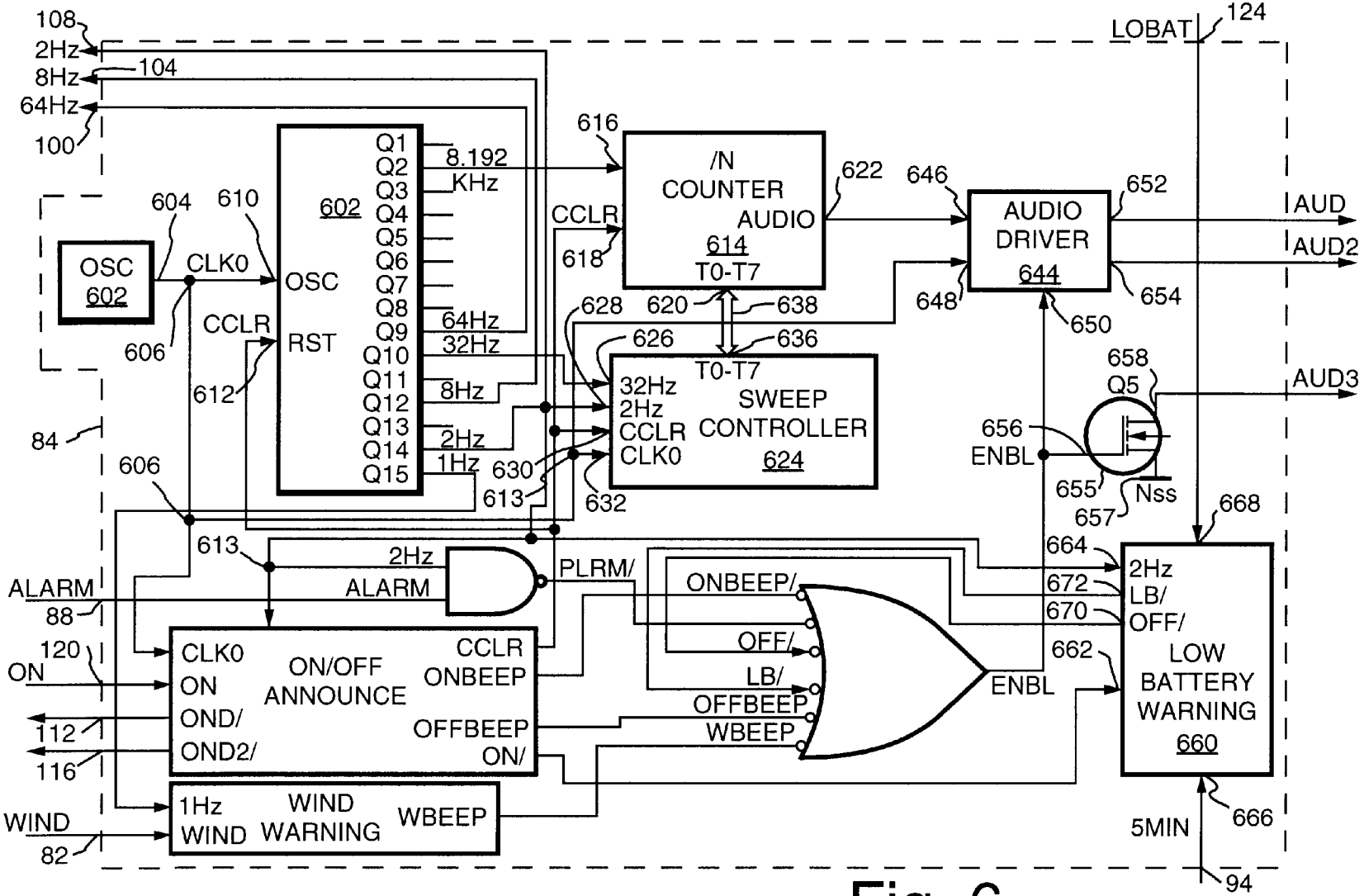
FIG. 6 is a detailed schematic circuit block diagram of the synthesizer of FIG. 1.

FIG. 6 shows a schematic block diagram at 600 of the synthesizer 84 of FIG. 1. The synthesizer includes: an oscillator 602 having an output 604 coupled to provide a clock zero signal (CLK0 signal) to a node 606; a counter 608 having an inverted clock input 610 coupled to receive the CLK0 signal via node 606, a reset input 612 coupled to receive a counter clear signal (CCLR signal) via a node 613, and 15 outputs designated Q1–Q15. The output Q9 provides a 64 Hz signal to the output 100 of the synthesizer 84, output Q12 provides an 8 Hz signal to the output 104 of the synthesizer, and output Q14 provides a 2 Hz signal to the output 108 of the synthesizer via a node 615. The synthesizer further includes: an audio sweep circuit 614 including an input 616 connected to output Q2 of counter 608 to receive an 8.192 KHz signal, an input 618 coupled to receive the CCLR signal via the node 613, an input 620 coupled to receive eight sweep signals designated T0–T7, and an output 622 providing an AUDIO signal; a sweep controller 624 having an input 626 connected to output Q10 of counter 608 to receive a 32 Hz signal, an input 628 connected to output Q14 of the counter 608 via node 615 to receive a 2 Hz signal, an input 630 coupled to receive the CCLR signal via node 613, an input 632 coupled to receive the CLK0 signal via node 606, and an output 636 coupled to provide the sweep signals T0–T7 to the input 620 of the audio sweep circuit 614 via a bus 638; an audio driver circuit 644 having an input 646 connected to output 622 of circuit 614 to receive the AUDIO signal, an input 648 coupled to receive the CLK0 signal via node 606, an input 650 coupled to receive an enable signal (ENBL signal) via a node 651, an output 652 coupled to provide a first audio driver signal (AUD1 signal) to the output of the synthesizer 84 via bus 30, and an output 654 coupled to provide a second audio driver signal (AUD2 signal) from synthesizer 84 via bus 130; a transistor 655 having a gate 656 connected to receive the ENBL signal via node 651, a source 657 connected to VSS, and a drain 658 coupled to provide a third audio driver signal (AUD3 signal) from the synthesizer 84 via bus 130; a low battery warning circuit 660 having an input 662 coupled to receive the ON/ signal, an input 664 coupled to receive the 2 Hz signal from output Q14 of counter 608 via node 615, an input 666 coupled to receive the PER signal via input 94 of the synthesizer, an input 668 coupled to receive the LOBAT signal from the ON/OFF control circuit 14 (FIG. 1) via input 124 of the synthesizer, an output 670 providing an inverted OFF/ signal, and an output 672 providing a low battery driver signal (LB/ signal); an ON/OFF announce circuit 680 including an input 682 coupled to receive the CLK0 signal via node 606, an input 684 coupled to receive the system status signal (ON signal) via input 120 of the synthesizer, an input 686 coupled to receive the 2 Hz signal from output Q14 of the counter 608 via node 615, an output 688 coupled to provide an OND/ signal to output 112 of the synthesizer, an output 690 coupled to provide an OND2/ signal to the output 116 of the synthesizer, an output 692 coupled to provide the CCLR signal to node 613, an output 694 providing a system ON driver signal (ONBEEP signal), an output 696 providing a system OFF driver signal (OFFBEEP signal), and an output 698 providing the inverted system status signal (ON/ signal); a NAND gate 700 having an input 702 coupled to receive the 2 Hz signal from output Q14 of counter 608 via node 615, an input 704 coupled to receive the ALARM signal via input 88 of the synthesizer, and an output 706 providing an alarm driver signal (PLRM/ signal); a wind warning circuit 708 having an input 710 coupled to receive a 1 Hz signal from output Q15 of counter 608, an input 712 coupled to receive the WIND signal via input 82 of the synthesizer, and an output 714 providing a wind warning driver signal (WBEEP signal); an OR gate 720 having an inverted input 722 coupled to receive the ONBEEP signal from output 694 of circuit 680, an inverted input 724 connected to the output 706 of NAND gate 700 to receive the PLRM/ signal, an inverted input 726 coupled to receive the inverted OFF/ signal from output 670 of the low battery warning circuit 660, an inverted input 728 coupled to receive the inverted LB/ signal from output 672 circuit 660, an inverted input 730 connected to output 696 of circuit 680 to receive the OFFBEEP signal, an inverted input 732 coupled to receive the WBEEP signal from output 714 of the wind warning circuit 708, and an output 734 providing the ENBL signal to the audio drive circuit 644 and driver transistor 655 via node 651.

As explained further below, when the ENBL signal provided by gate 720 transitions HI, the audio driver 644 provides audio signals (AUD1, AUD2, and AUD3) to the speaker 128 (FIG. 1) which generates a noise. Transistor 655 provides a means of driving a Piezo-electric speaker, which includes a DC driver and an internal oscillator as an alternative to driving a conventional electromagnetic or Piezo-electric speaker via audio driver 644.

As explained further below, when the pool alarm system 10 (FIG. 1) is initially armed, upon an OFF to ON transition initiated by a user via the ON/OFF switch 182 (FIG. 1), synthesizer 84 generates a single beep sound. While the system is armed, the synthesizer is silent unless the LOBAT signal is HI. While the pool alarm system is disarmed, synthesizer 84 generates two beep sounds at the end of every preset warning period and also in initial response to the ON to OFF transition. In the preferred embodiment, the preset warning period is five minutes and the synthesizer generates two beep sounds every five minutes to indicate that the system is currently disarmed. If the system battery bank 12 (FIG. 1) is sufficiently low, the LOBAT signal provided by the voltage monitor circuit 14 is HI and the synthesizer 84 generates three beep sounds every five minutes. If the WIND signal is activated, the synthesizer generates continuous 1.5 second beep sounds. If the ALARM signal is activated, the synthesizer generates a continuous series of beeps (0.25 seconds on, 0.25 seconds off).

FIG. 7A shows a detailed schematic circuit diagram of the oscillator 602, counter 608, audio sweep circuit 614, and sweep controller 624 of FIG. 6. The oscillator 602 includes: a crystal 750 having a terminal connected to a node 752, and an opposite terminal connected to a node 754; a first capacitor 756 having a terminal connected to node 752, and an opposite terminal connected to VSS; a second capacitor 758 having a terminal connected to node 754, and an opposite terminal connected to VSS; a resistor 760 having a terminal connected to node 752, and an opposite terminal connected to node 754; a resistor 762 having a terminal connected to node 754, and an opposite terminal connected to a node 764; an inverter 766 having an input 768 connected to node 752, and an output 770 connected to node 764; an inverter 772 having an input 774 connected to node 764, and an output 776 providing the CLK0 signal to output 604 of the oscillator 602. The audio sweep circuit 614 includes: a 5-bit shift register 780 having a clock input 782 coupled to receive the 8.192 KHz signal via input 616 of the circuit 614, a reset input 784 coupled to receive the CCLR signal via input 618 of the circuit 614, a data input 786 connected to receive an AUDIO signal, and five inverted outputs 788, 790, 792, 794, and 796 providing signals J1/, J2/, J3/, J4/, and J5/ respectively; an AND gate 800 having an input 802 connected to receive the J1/ signal from output 788 of shift register 780, an input 804 connected to receive the J2/ signal from output 790 of shift register 780 via a node 805, and an output 806; an AND gate 808 having an input 810 connected to receive the J2/ signal from output 790 of shift register 780, an input 812 connected to receive the J3/ signal from output 792 of shift register 780, and an output 814; an AND gate 816 having an input 818 connected to receive the J2/ signal from output 792 of shift register 780, an input 820 connected to receive the J4/ signal from output 794 of shift register 780, and an output 822; an AND gate 824 having an input 826 coupled to receive the J4/ signal from output 794 of shift register 780, an input 828 connected to receive the J5/ signal from output 796 of shift register 780, and an output 830; a first analog switch 840 having an input 844 connected to receive the signal T0, an input 842 connected to receive the J5/ signal from output 796 of shift register 780, and an output 846 connected to output 622 of circuit 614 via a node 848; a second analog switch 850 having an input 854 connected to receive the T1 signal, an input 852 connected to output 830 of AND gate 824, and an output 856 connected to node 848; a third analog switch 858 having an input 860 connected to receive the J4/ signal from output 794 of shift register 780, an input 862 connected to receive the T2 signal, and an output 864; a fourth analog switch 866 having an input 868 connected to output 822 of AND gate 816, an input 870 connected to receive the T3 signal, and an output 872 connected to node 848; a fifth analog switch 874 having an input 876 connected to output 792 of shift register 780, an input 878 connected to receive the T4 signal, and an output 880 connected to node 848; a sixth analog switch 882 having an input 884 connected to output 814 of AND gate 808, an input 886 connected to receive the T5 signal, and an output 888 connected to node 848; a seventh analog switch 890 having an input 892 connected to receive the J2/ signal from output 790 of shift register 780, an input 894 connected to receive the T6 signal, and an output 896 connected to node 848; and an eighth analog switch 898 having an input 900 connected to output 806 of AND gate 800, an input 902 connected to receive the T7 signal which has a frequency of 2.73 KHz, and an output 904 connected to node 848.

The sweep controller 624 includes: a flip-flop 910 having a data input 912 connected to receive the 2 Hz signal via input 628 of the sweep controller, a clock input 914 connected to receive the CLK0 signal via input 632 of the sweep controller, an inverted asynchronous set input 916 connected to VDD, an inverted asynchronous clear input 918 connected to VDD, an output 920 providing a U/D signal, and an inverted output 922; an AND gate 924 having an input 926 connected to output 922 of flip-flop 910, an input 928 connected to receive the 2 Hz signal via input 628 of the sweep controller, and an output 930; an OR gate 932 having an input 934 connected to output 930 of AND gate 924, an input 936 connected to receive the CCLR signal via input 630 of the sweep controller, and an output 937; an inverter 938 having an input 940 connected to receive the 32 Hz signal from output Q10 of counter 608 via input 626 of the sweep controller, and an output 942; a four-bit UP/DOWN counter 944 having an UP/DOWN input 946 connected to receive the U/D signal from output 920 of flip-flop 910, a reset input 948 connected to output 937 of OR gate 932, and an inverted clock input 950 connected to output 942 of inverter 938, a first output 952 providing a K1 signal, a second output 954 providing a K2 signal, a third output 956 providing a K3 signal, and a fourth output 958 which is not used; a decoder 960 having a first input 962 connected receive the K1 signal from output 952 of the UP/DOWN counter, a second input 964 connected to receive the K2 signal from output 954 of the UP/DOWN counter, a third input 965 connected to receive the K3 signal from output 956 of the UP/DOWN counter, and eight outputs designated Y0–Y7 providing the eight sweep control signals T0–T7 to the audio sweep circuit 614 via bus 638.

When flip-flop 910, is set, the U/D signal provided at its output 920 transitions from LO to HI causing the counter 944 to begin counting upward as clocked by the 32 Hz signal received from the oscillator 602. As the counter 944 counts upward, the signals K1, K2, and K3 provided at outputs 952, 954, and 956 of the counter respond as shown. The sweep control signals T0–T7, provided at outputs Y0–Y7 of decoder 960, step from LO to HI and back to LO again one at a time as the counter 944 counts up and down as controlled by the U/D signal. The reset signal received at input 948 of counter 944 is a positive pulse approximately 30 $\mu$S wide at the rising edge of the 2 Hz signal provided at input 912 of flip-flop 910. This signal sets counter 944 to a known state via gate 932. Counter 944 is also reset by the CCLR signal received at its reset input 948 via gate 932.

Figure 7B:
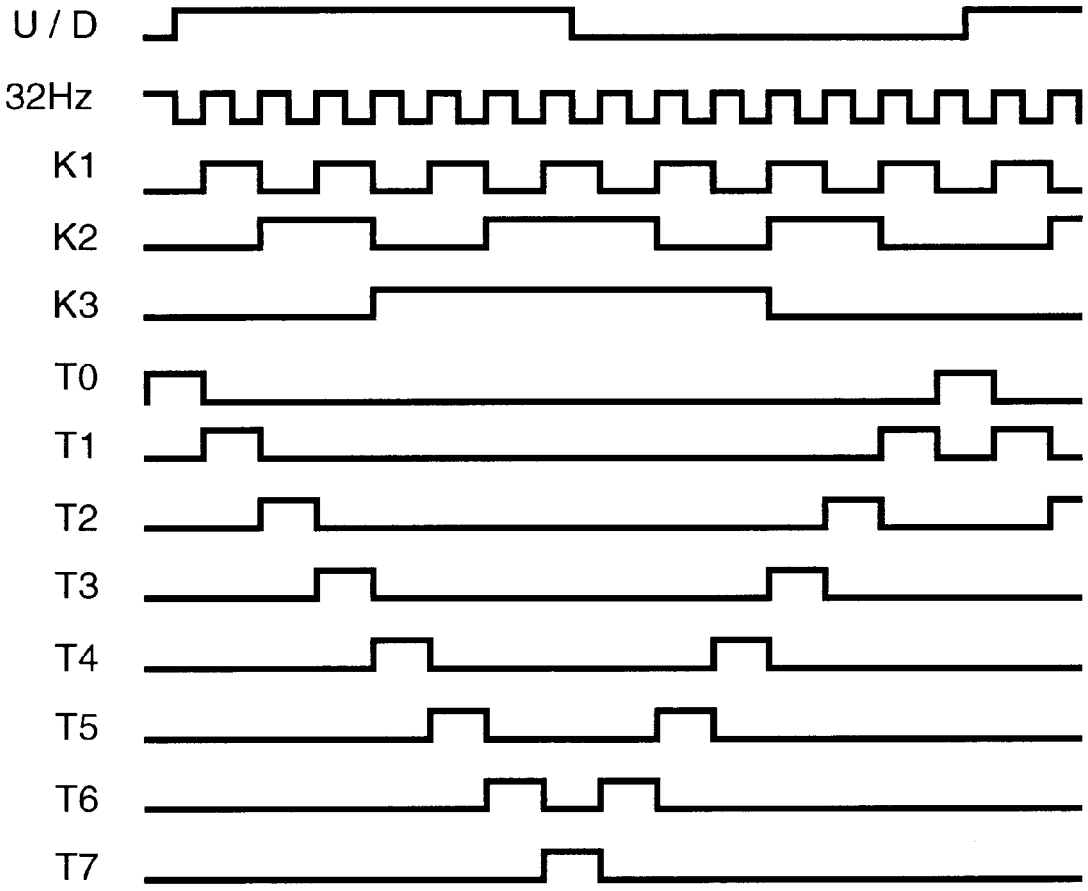
FIG. 7B is a timing diagram illustrating operation of a sweep controller of the sub-circuit of FIG. 7A.

FIG. 7B shows a timing diagram illustrating operation of the sweep controller 624 (FIG. 7A) as evidenced by wave forms labeled in accordance with the signal names shown in FIG. 7A. The depicted wave forms represent signals including: the U/D signal received at input 946 of counter 944

(FIG. 7A); the 32 Hz signal provided by the oscillator (FIG. 7A); the K1, K2, and K3 signals provided respectively at outputs 952, 954, and 956 of counter 944 (FIG. 7A); and the sweep control signal T0–T7 provided at outputs Y0–Y7 of decoder 960 (FIG. 7A).

When the U/D signal transitions from LO to HI, counter 944 (FIG. 7A) counts upward, the eight sweep control signals T0–T7 transition from LO to HI and back to LO one at a time in order beginning with T0 and ending with T7, and the frequency of the AUDIO signal (wave form not shown) generated at node 848 of circuit 614 (FIG. 7A) to sweeps upward from 819 Hz to 2.73 KHz in eight steps. When the U/D signal transitions from LO to HI, counter 944 (FIG. 7A) counts downward, the eight sweep control signals T0–T7 transition from LO to HI and back to LO one at a time in reverse order beginning with T7 and ending with T0, and the frequency of the AUDIO signal (wave form not shown) generated at node 848 of circuit 614 sweeps downward from 2.73 KHz to 819 Hz in eight steps. Each of the eight discrete frequency values of the AUDIO signal is equal to the frequency of the 8.192 KHz CLK signal (received at input 782 of register 780) divided by an integer number.

Figure 7C:
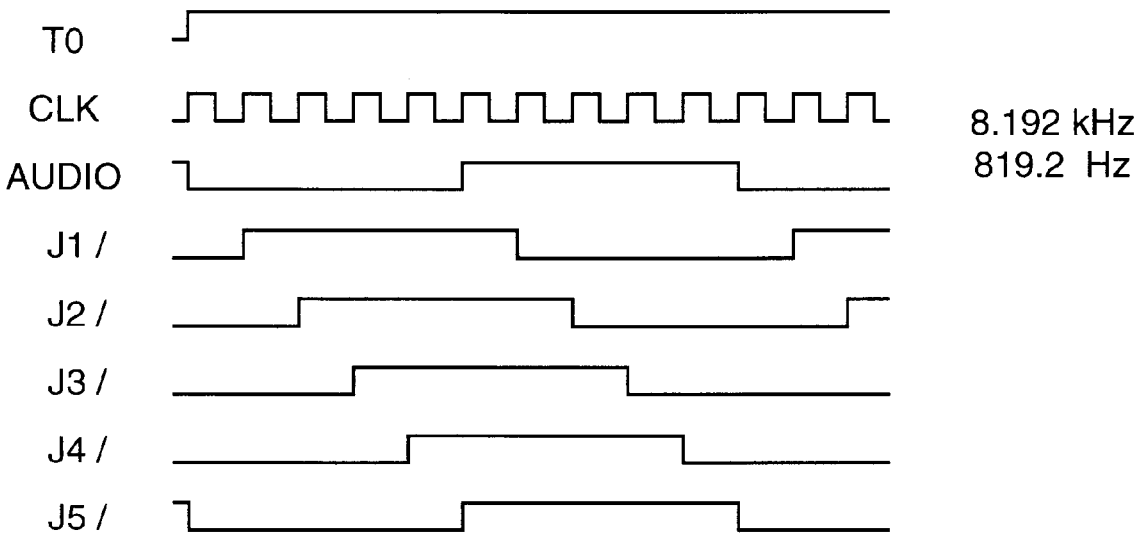
FIG. 7C is a timing diagram illustrating operation of an audio sweep circuit of the sub-circuit of FIG. 7A during a first exemplary time period.

FIG. 7C shows a timing diagram illustrating operation of the audio sweep circuit 614 (FIG. 7A) as controlled by the sweep controller 624 (FIG. 7A) during a first period wherein the sweep control signal T0 transitions from LO to HI. The depicted wave forms, which are labeled in accordance with the signal names shown in FIG. 7A, represent: the sweep control signal T0 provided at output Y0 of decoder 960 (FIG. 7A); the 8.192 KHz CLK signal received at input 782 of register 780 (FIG. 7A); the AUDIO signal generated at node 848 (FIG. 7A); and the five signals J1/, J2/, J3/, J4/, and J5/ provided at the inverted outputs 788, 790, 792, 794, and 796 respectively of register 780 (FIG. 7A). While the sweep control signal T0 is HI, the AUDIO signal operates at a frequency of 819.2 Hz.

Figure 7D:
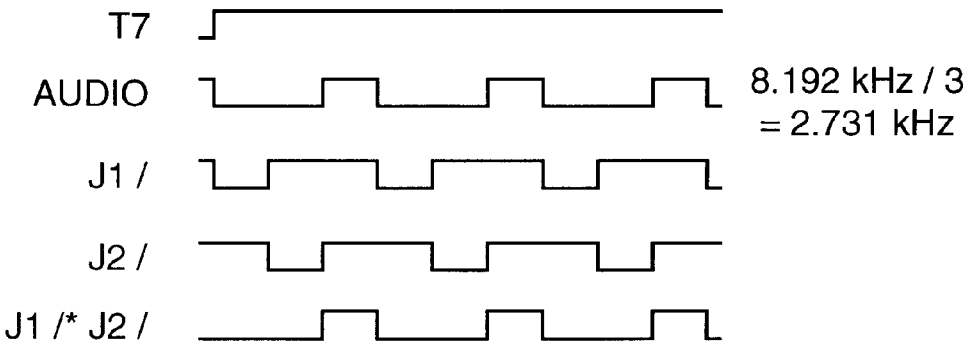
FIG. 7D is a timing diagram illustrating operation of the audio sweep circuit of the sub-circuit of FIG. 7A during a second exemplary time period.

FIG. 7D shows a timing diagram illustrating operation of the audio sweep circuit 614 (FIG. 7A) as controlled by the sweep controller 624 (FIG. 7A) during a second period wherein the sweep control signal T7 transitions from LO to HI. The depicted wave forms, which are labeled in accordance with the signal names shown in FIG. 7A, represent: the sweep control signal T7 provided at output Y7 of decoder 960 (FIG. 7A); the 8.192 KHz CLK signal received at input 782 of register 780 (FIG. 7A); the AUDIO signal generated at node 848 (FIG. 7A); and the signals J1/ and J2/ provided from inverted outputs 788 and 790 of register 780 (FIG. 7A), and the signal provided at output 806 of gate 800 (FIG. 7A) which has a value J1/*J2/. While the sweep control signal T7 is HI, the AUDIO signal operates at a frequency of 2.73 KHz.

Figure 8:
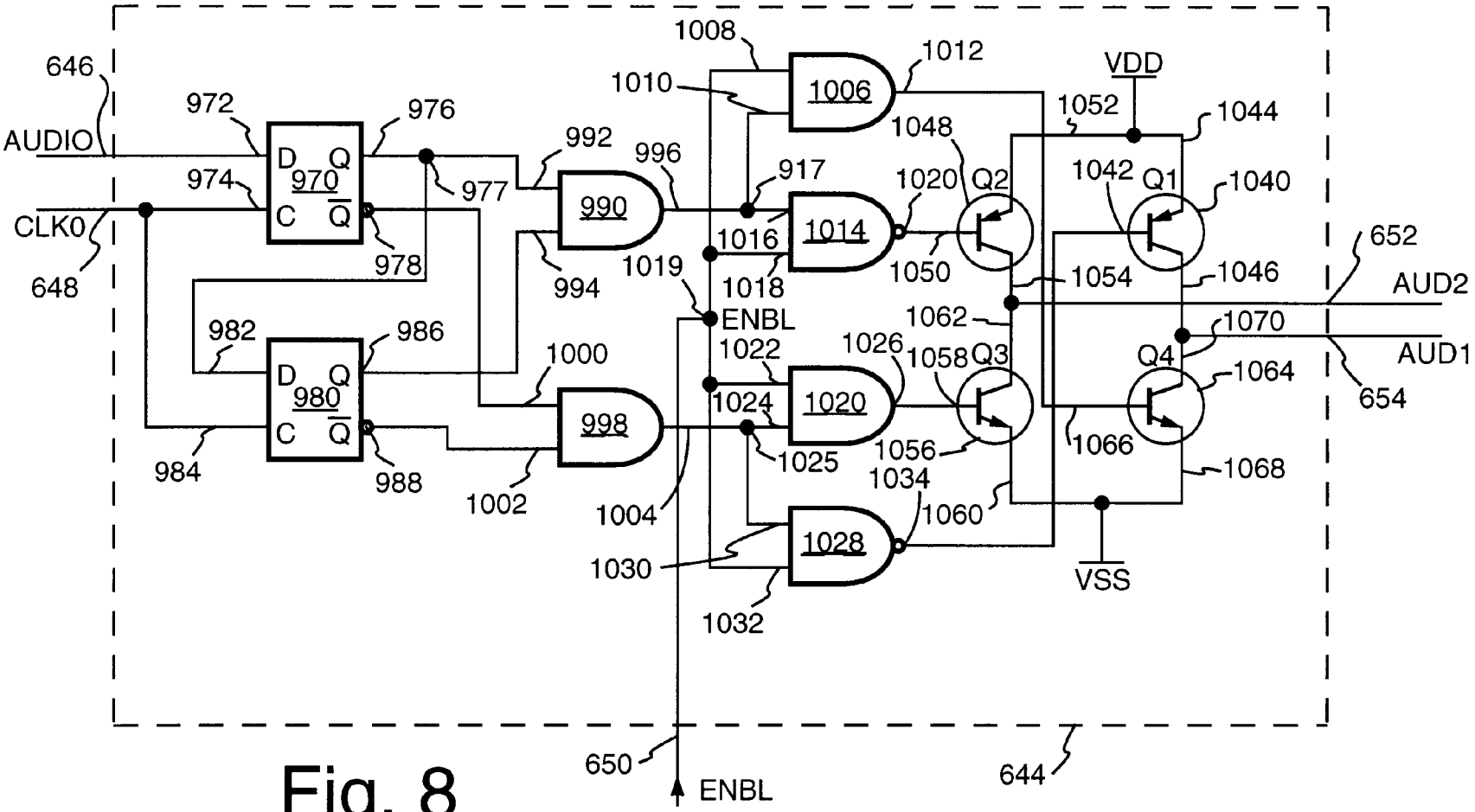
FIG. 8 is a detailed schematic diagram of an audio driver sub-circuit of the synthesizer of FIG. 6.

FIG. 8 shows a detailed schematic diagram of the audio driver circuit 644 of the synthesizer of FIG. 6. The audio driver 644 includes: a flip-flop 970 having a data input 972 connected to receive the AUDIO signal via input 646 of the audio driver circuit, a clock input 974 connected to receive the CLK0 signal via input 648 of the audio driver circuit, an output 976 connected to a node 977, and an inverted output 978; a flip-flop 980 having a data input 982 connected to output 976 of flip-flop 970 via node 977, a clock input 984 connected to receive the CLK0 signal via input 648 of the audio driver, an output 986 and an inverted output 988; an AND gate 990 having an input 992 connected to output 976 of flip-flop 970 via node 977, an input 994 connected to output 986 of flip-flop 980, and an output 996; an AND gate 998 having an input 1000 connected to the inverted output 978 of flip-flop 970, an input 1002 connected to the inverted output 988 of flip-flop 980, and an output 1004; an AND gate 1006 having an input 1008 connected to receive the ENBL signal from input 650 of the audio driver circuit via a node 1009, an input 1010 connected to output 996 of AND gate 990 via a node 997, and an output 1012; a NAND gate 1014 having an input 1016 connected to the node 997, an input 1018 connected to receive the ENBL signal via node 1019, and an output 1020; an AND gate 1020 having an input 1022 connected to receive the ENBL signal, an input 1024 connected to output 1004 of AND gate 998 via a node 1025, and an output 1026; a NAND gate 1028 having an input 1030 connected to node 1025, an input 1032 connected to receive the ENBL signal via node 1019, and an output 1034; a first transistor 1040 having a base 1042 connected to output 1034 of NAND gate 1028, an emitter 1044 connected to VDD, and a collector 1046 connected to the first audio output 654 of the audio driver circuit; a second transistor 1048 having a base 1050 connected to output 1020 of NAND gate 1014, an emitter 1052 connected to VDD, and a collector 1054 connected to provide the AUD2 signal via output 652 of the audio driver circuit; a third transistor 1056 having a base 1058 connected to output 1026 of AND gate 1020, an emitter 1060 connected to VSS, and a collector 1062 connected to the second audio output 652 of the audio driver circuit; and a fourth transistor 1064 having a base 1066 connected to output 1012 of AND gate 1006, an emitter 1068 connected to VSS, and a collector 1070 connected to the first audio output 654 of the audio driver circuit.

Figure 9:
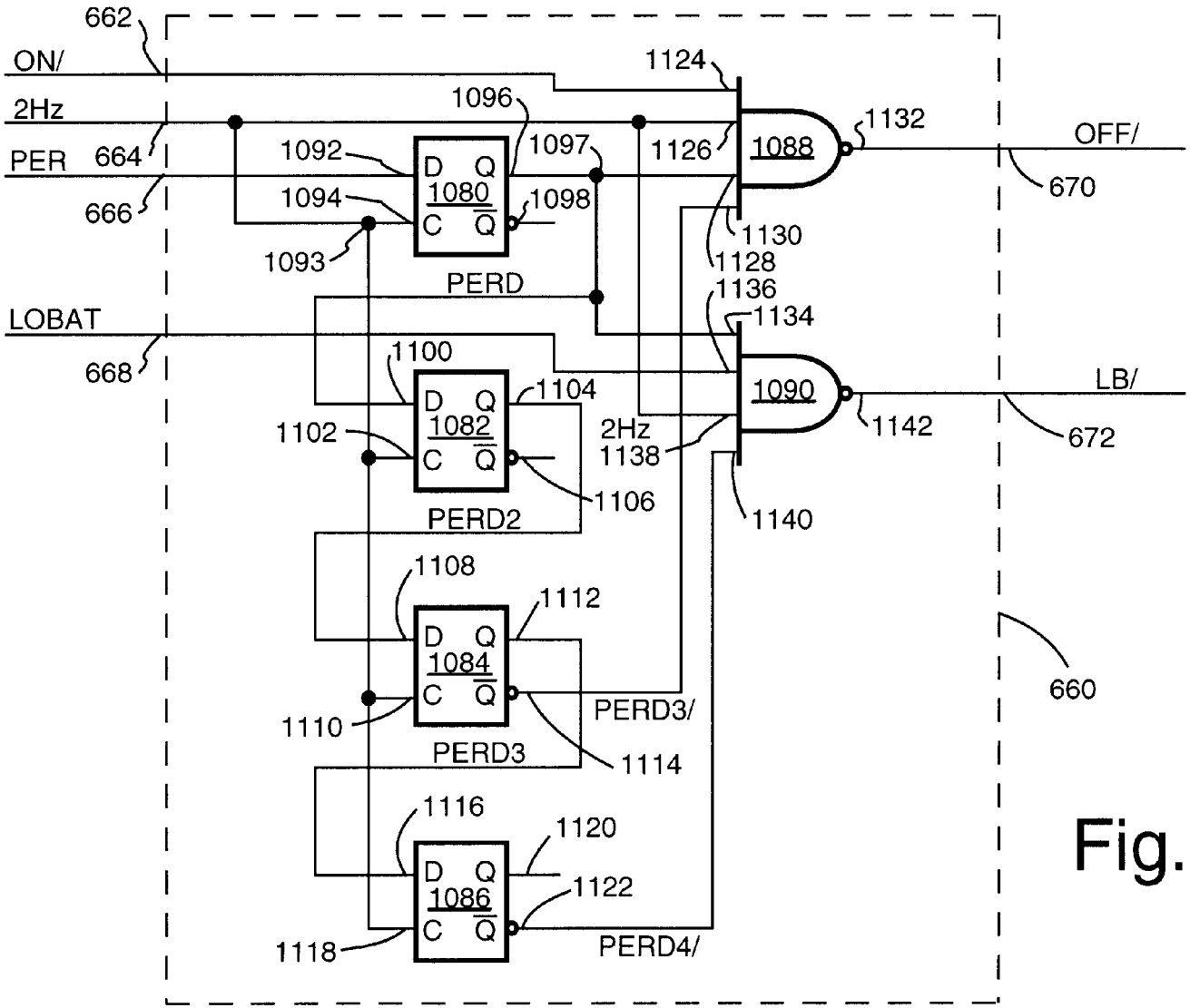
FIG. 9 is a detailed schematic diagram of a periodic warning sub-circuit of the synthesizer of FIG. 6.

FIG. 9 shows a detailed schematic circuit diagram of the low battery warning circuit 660 of the synthesizer 84 of FIG. 6. The circuit 660 includes four flip-flops 1080, 1082, 1084, 1086 and two NAND gates 1088, 1090. The first flip-flop 1080 includes a data input 1092 connected to receive the PER signal via input 666 of the low battery warning circuit, a clock input 1094 connected to receive the 2 Hz signal via input 664 of the circuit 660 and a node 1093, an output 1096 coupled to provide PERD signal to a node 1097, and an inverted output 1098. The second flip-flop 1082 includes a data input 1100 connected to receive the PERD signal from output 1096 of flip-flop 1080, a clock input 1102 connected to receive the 2 Hz signal via node 1093, an output 1104 providing a PERD2 signal, and an inverted output 1106. The third flip-flop 1084 includes a data input 1108 connected to receive the PERD2 signal from output 1104 of flip-flop 1082, a clock input 1110 connected to receive the 2 Hz signal via node 1093, an output 1112 providing a PERD3 signal, and an inverted output 1114 providing an inverted PERD3/ signal. The fourth flip-flop 1086 includes a data input 1116 connected to receive the PERD3 signal from output 1112 of flip-flop 1084, a clock input 1118 connected to receive the 2 Hz signal via node 1093, an output 1120, and an inverted output 1122 providing an inverted PERD4/ signal. The first NAND gate 1088 includes an input 1124 connected to receive the inverted ON/ signal via input 662 of circuit 660, an input 1126 connected to receive the 2 Hz signal via node 1093, an input 1128 connected to receive the PERD signal from output 1096 of flip-flop 1080, and an input 1130 connected to receive the inverted PERD3/ signal from output 1114 of flip-flop 1084. The second NAND gate 1090 includes an input 1134 connected to receive the PERD signal via node 1097, an input 1136 connected to receive the LOBAT signal via input 668 of the circuit 660, an input 1138 connected to receive the 2 Hz signal via node 1093, an input 1140 connected to receive the inverted PERD4/ signal via the inverted output 1122 of flip-flop 1086, and an output 1142 providing the LB/ signal to output 672 of circuit 660.

Figure 10:
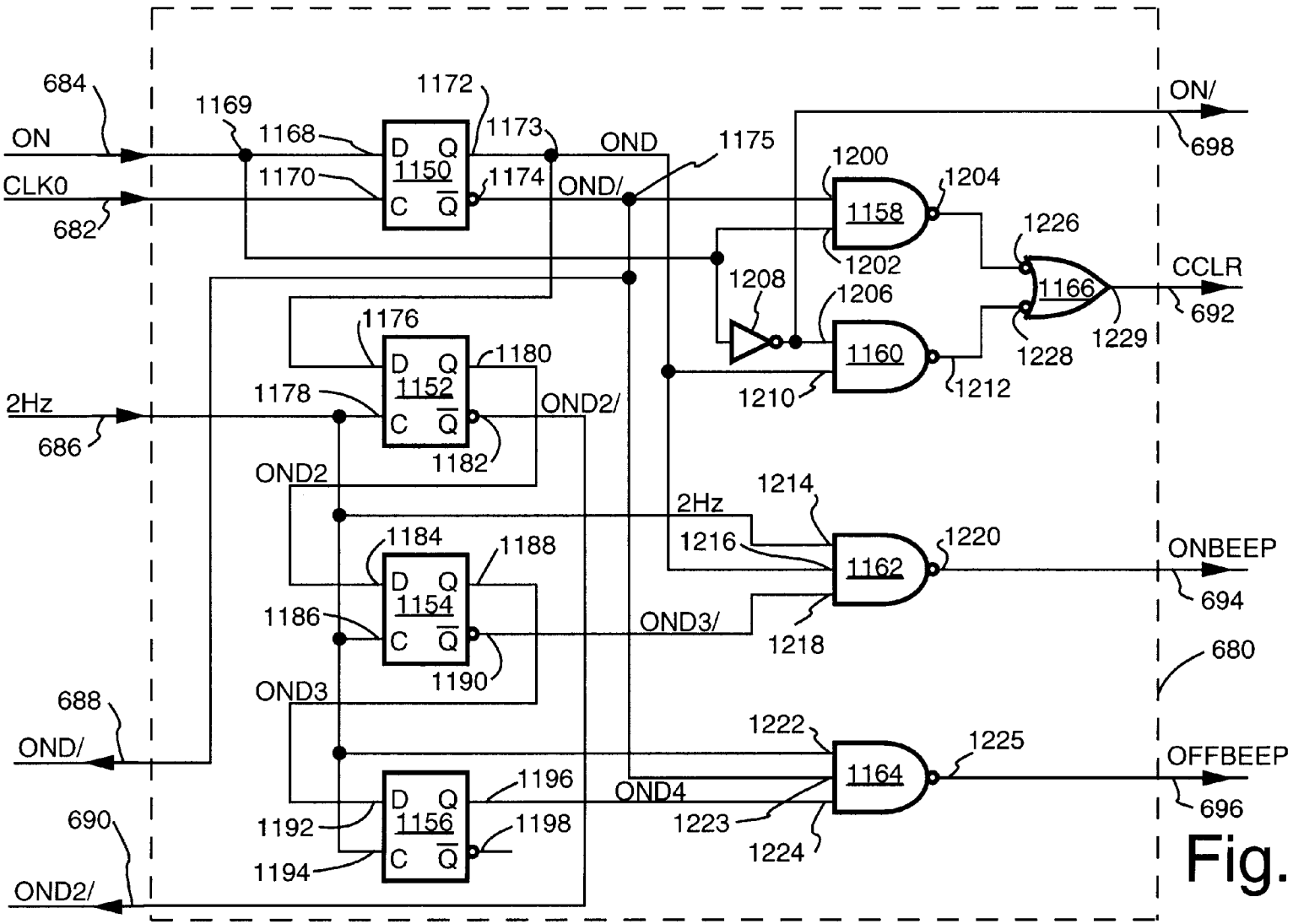
FIG. 10 is a detailed schematic diagram of an ON/OFF announce sub-circuit of the synthesizer of FIG. 6.

FIG. 10 shows a detailed schematic diagram of the ON/OFF announce circuit 680 of the synthesizer 84 of FIG.

6. The ON/OFF announce circuit includes: four flip-flops 1150, 1152, 1154 and 1156, four NAND gates 1158, 1160, 1162, 1164, and an OR gate 1166. The flip-flop 1150 includes a data input 1168 connected to receive the system status signal (ON signal) from input 684 of circuit 680 via a node 1169, a clock input 1170 connected to receive the CLK0 signal via input 682 of circuit 680, an output 1172 coupled to provide an OND signal to a node 1173, and an inverted output 1174 connected to provide an inverted OND/ signal to a node 1175. The flip-flop 1152 includes a data input 1176 connected to receive the OND signal via node 1173, a clock input 1178 connected to receive the 2 Hz signal via input 686 of circuit 680, an output 1180 providing an OND2 signal, and an inverted output 1182 coupled to provide an inverted OND2/ signal to the output 690 of circuit 680. The flip-flop 1154 includes a data input 1184 connected to receive the OND2 signal from output 1180 of flip-flop 1152, a clock input 1186 connected to receive the 2 Hz signal, an output 1188 providing an OND3 signal, and an inverted output 1180 providing an inverted OND3/ signal. The flip-flop 1156 includes a data input 1192 connected to output 1188 of flip-flop 1154 to receive the OND3 signal, a clock input 1194 connected to receive the 2 Hz signal, an output 1196 providing an OND4 signal, and an inverted output 1198. NAND gate 1158 includes an input 1200 connected to receive the inverted OND/ signal via node 1175, an input 1202 connected to receive the ON signal via node 1169, and an output 1204. NAND gate 1160 includes an input 1206 connected to receive the inverted ON/ signal via an inverter 1208, an input 1210 connected to receive the OND signal via node 1173, and an output 1212. NAND gate 1162 includes an input 1214 connected to receive the 2 Hz signal, an input 1216 connected to receive the OND signal from output 1172 of flip-flop 1150, an input 1218 connected to receive the inverted OND3/ signal from output 1190 of flip-flop 1154, and an output 1220 coupled to provide the ONBEEP signal to output 694 of circuit 680. NAND gate 1164 includes an input 1222 connected to receive the 2 Hz signal, an input 1223 connected to receive the inverted OND/ signal from output 1174 of flip-flop 1150, an input 1224 connected to receive the OND4 signal from output 1196 of flip-flop 1156, and an output 1225 coupled to provide the OFFBEEP signal to output 696 of circuit 680. OR gate 1166 includes an inverted input 1226 connected to the output 1204 of gate 1158, an inverted input 1228 connected to output 1212 of gate 1160, and an output 1229 providing the CCLR signal to output 692 of circuit 680.

Figure 11:
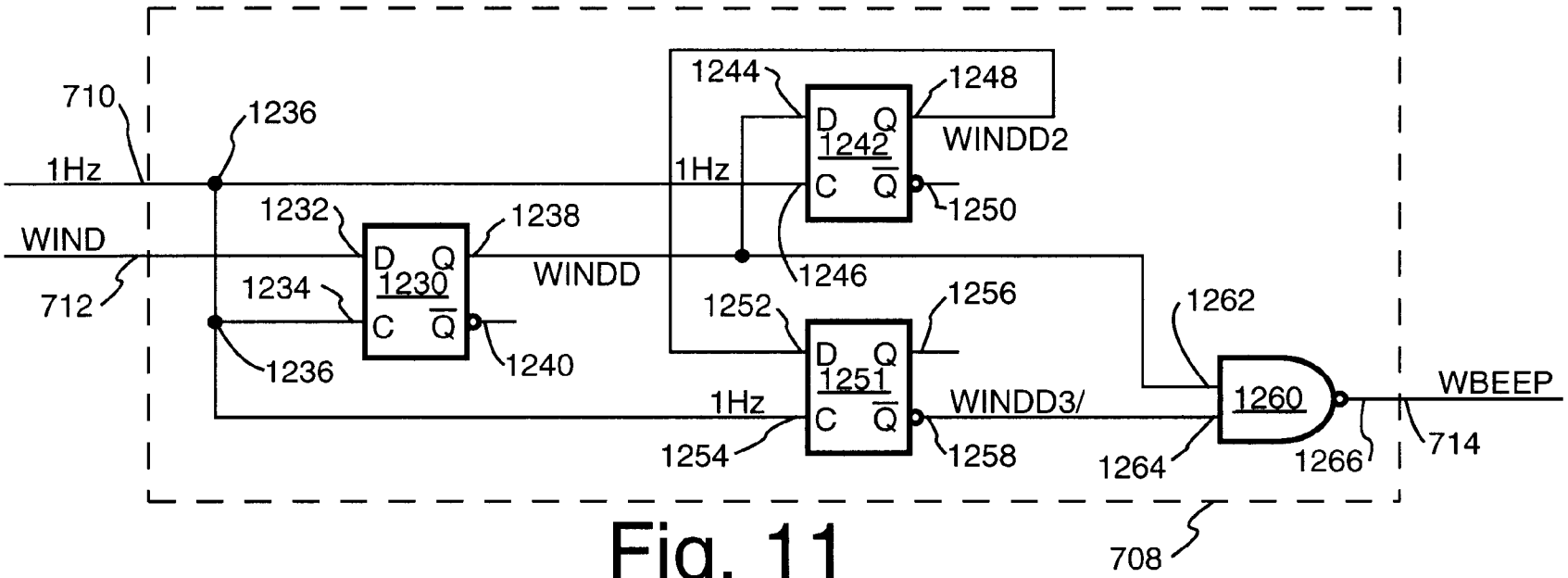
FIG. 11 is a detailed schematic circuit diagram of a wind warning sub-circuit of the synthesizer of FIG. 6.

FIG. 11 shows a detailed schematic circuit diagram of the wind warning circuit 708 of the synthesizer 84 of FIG. 6. The circuit 708 includes: a flip-flop 1230 having a data input 1232 connected to receive the WIND signal via input 712 of circuit 708, a clock input 1234 connected to receive the 1 Hz signal via input 710 of circuit 708 and a node 1236, an output 1238 providing a WINDD signal, and an inverted output 1240; a flip-flop 1242 having a data input 1244 connected to receive the WINDD signal from output 1238 of flip-flop 1230, a clock input 1246 connected to receive the 1 Hz signal via node 1236, an output 1248 providing a WINDD2 signal, and an inverted output 1250; a flip-flop 1251 having a data input 1252 connected to receive the WINDD2 signal from output 1248 of flip-flop 1242, a clock input 1254 connected to receive the 1 Hz signal via node 1236, an output 1256, and an inverted output 1258; and a NAND gate 1260 having an input 1262 connected to receive the WINDD signal from output 1238 of flip-flop 1230, an input 1264 connected to the inverted output 1258 of the flip-flop 1251, and an output 1266 connected to provide the WBEEP signal to the output 714 of the circuit 708.

Figure 12:
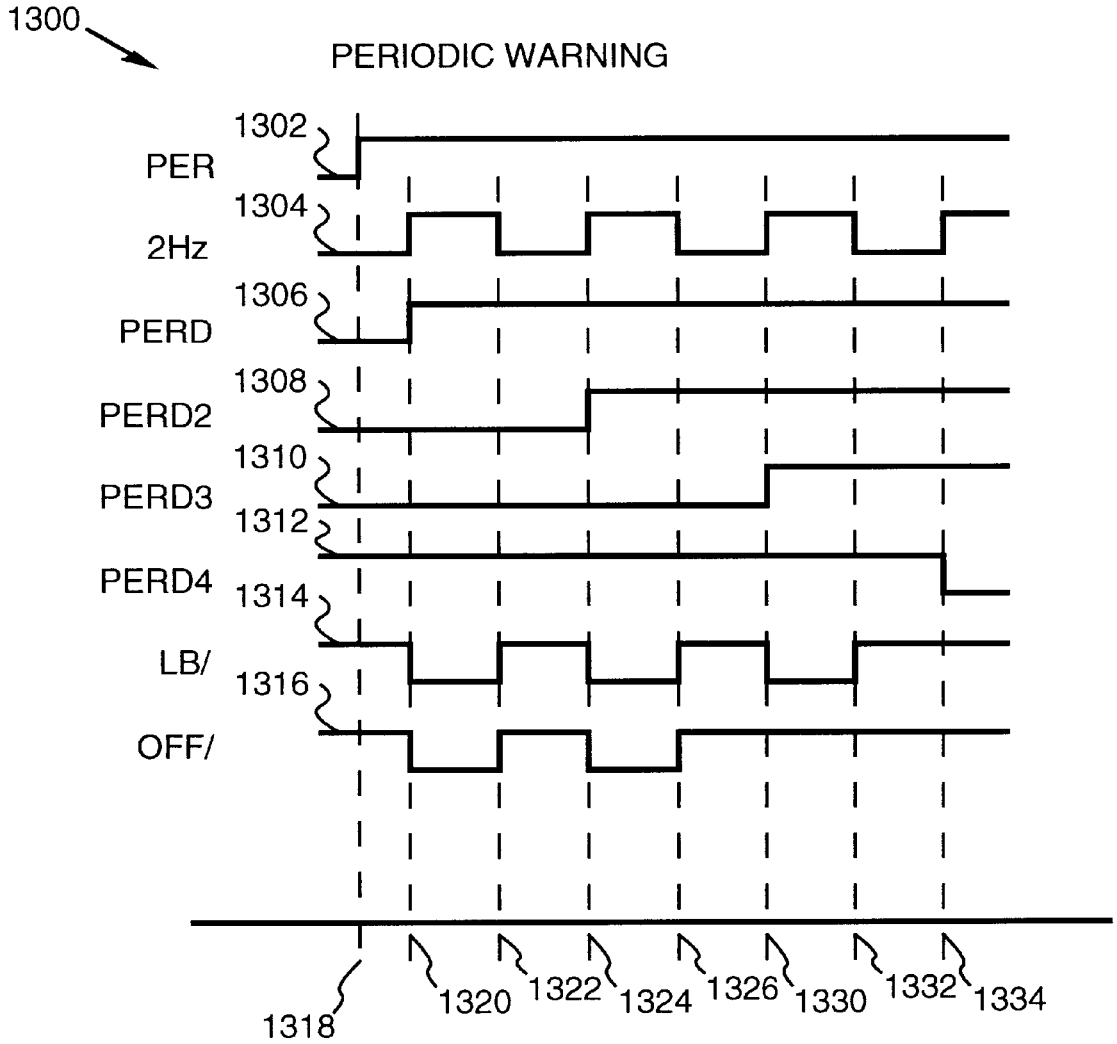
FIG. 12 is a timing diagram illustrating operation of the periodic warning sub-circuit of FIG. 9.

FIG. 12 shows a timing diagram at 1300 illustrating the timing of processing signals for operation of the periodic warning circuit 660 (FIG. 9) of the synthesizer in response to a system condition wherein the LOBAT signal received at input 668 of circuit 660 is HI (indicating that battery power is low as explained above), and the ON/ signal received at input 662 of circuit 660 is HI (indicating that the system is currently disarmed. The diagram depicts the processing signals causing the synthesizer 58 (FIG. 6) to chirp twice every five minutes to indicate that the system is currently disarmed, and three times every five minutes to indicate that the battery power is currently low. The diagram includes: a wave form 1302 representing the periodic warning signal (PER signal) provided by timer 494 (FIG. 3) of processor 58 and received at data input 1092 of flip-flop 1080 (FIG. 9): a wave form 1304 representing the 2 Hz signal received at the clock inputs of flip-flops 1080, 1082, 1084, and 1086; a wave form 1306 representing the PERD signal provided at output 1096 of flip-flop 1080; a wave form 1308 representing the PERD2 signal; a wave form 1310 representing the PERD3 signal; a wave form 1312 representing the PERD4/ signal; a wave form 1314 representing the low battery warning signal (LB/ signal) provided at output 1142 of gate 1090 (FIG. 9); and a wave form 1316 representing the OFF/ signal.

At a time 1318, the PER signal received at data input 1092 of flip-flop 1080 (FIG. 9) switches from LO to HI. As described above, the PER signal switches from LO to HI every five minutes. At a time 1320, upon the first positive going transition of the 2 Hz signal (wave form 1304) after the PER signal switches HI, flip-flop 1080 is set and the PERD signal provided at output 1096 of flip-flop 1080 switches from LO to HI. After the PERD signal (wave form 1306) switches HI at time 1320, flip-flops 1082, 1084, and 1086 (FIG. 9) are successively set by the next three positive going transitions of the 2 Hz signal (wave form 1304) and accordingly, the PERD2 signal (wave form 1308), PERD3 signal (wave form 1310), and PERD4 signal (wave form 1312) provided at outputs 1104, 1112, and 1120 of the flip-flops 1082, 1084, and 1086 switch from LO to HI at times 1324, 1330 and 1334 respectively. As shown, the LB/ signal (wave form 1314), provided at output 1142 of gate 1090 (FIG. 9), is driven LO when the LOBAT signal (wave form not shown), PERD signal (wave form 1306), PERD4 signal (wave form 1312), and 2 Hz signal (wave form 1304) are all HI. Therefore, the LB/ signal (wave form 1314) transitions LO three times between times 1320 and 1332 thereby driving the ENBL signal, provided at output 734 of gate 720 (FIG. 6) HI three times to activate three chirps. Also as shown, the OFF/ signal (wave form 1316), provided at output 1132 of gate 1088 (FIG. 9), is driven LO when the ON/ signal (wave form not shown), PERD signal (wave form 1306), PERD3 signal (wave form 1310), and 2 Hz signal (wave form 1304) are all HI. Therefore, the OFF/ signal (wave form 1316) transitions LO twice between times 1320 and 1326 thereby driving the ENBL signal, provided at output 734 of gate 720 (FIG. 6) HI twice to activate two chirps.

Figure 13:
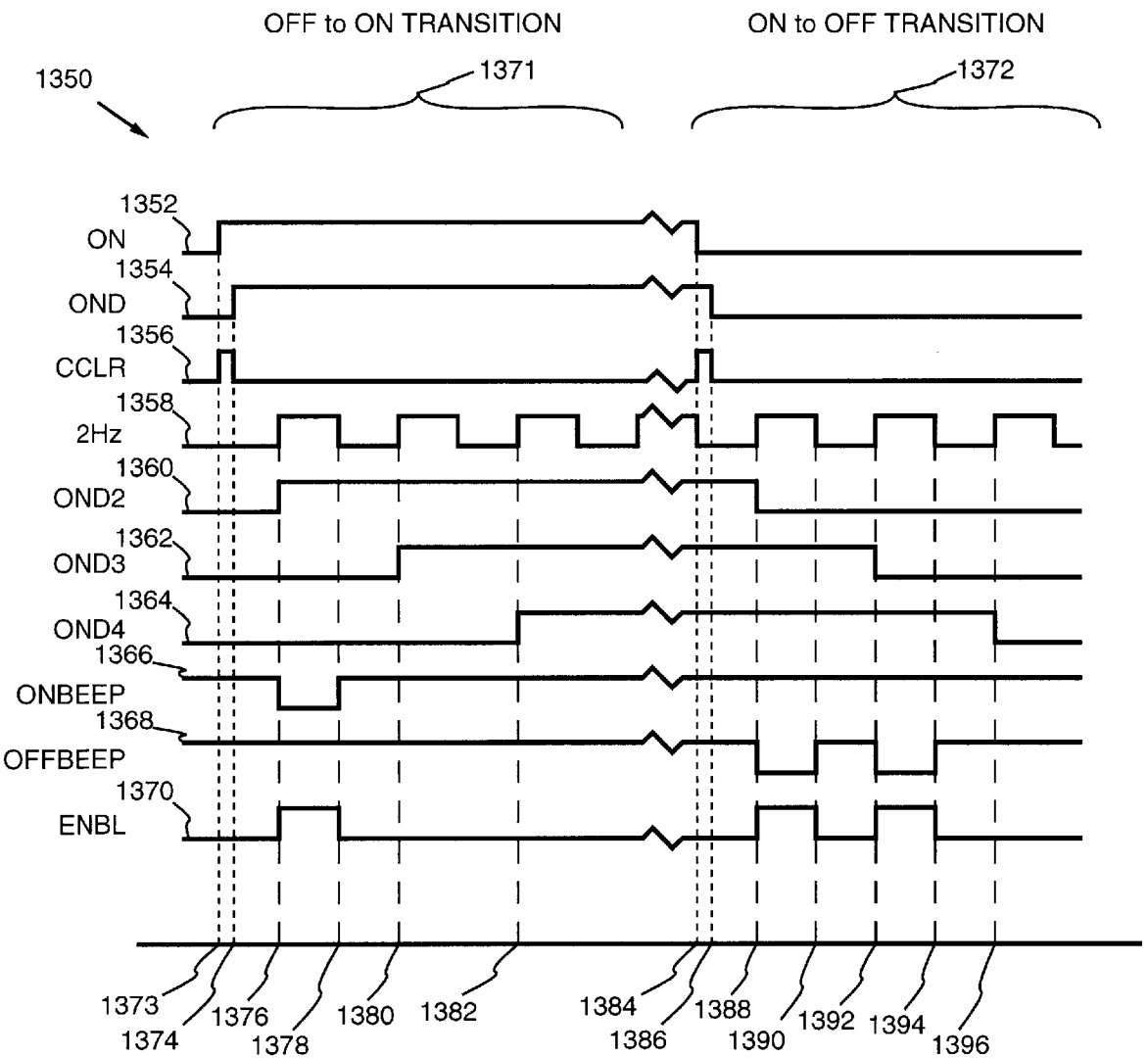
FIG. 13 is a timing diagram illustrating operation of the ON/OFF announce sub-circuit of FIG. 10.

FIG. 13 shows a timing diagram at 1350 illustrating the timing of processing signals for operation of the ON/OFF announce sub-circuit 680 of FIG. 10. The diagram includes a wave form 1352 representing the ON signal provided by the ON/OFF control circuit 16 (FIG. 1) to the input 684 (FIG. 10) of the circuit 680, a wave form 1354 representing the OND signal provided at output 1172 of flip-flop 1150 (FIG. 10), a wave form 1356 representing the CCLR signal provided at output 1229 of gate 1166 (FIG. 10), a wave form 1358 representing the 2 Hz signal received at input 686 (FIG. 10) of circuit 680, a wave form 1360 representing the OND2 signal provided at output 1180 of flip-flop 1152 (FIG. 10), a wave form 1362 representing the OND3 signal provided at output 1188 of flip-flop 1154 (FIG. 10), a wave form 1364 representing the OND4 signal provided at output 1196 of flip-flop 1156 (FIG. 10), a wave form 1366 representing the ONBEEP signal provided at output 1220 of gate 1162 (FIG. 10), a wave form 1368 representing the OFFBEEP signal provided at output 1228 of gate 1164 (FIG. 10), and a wave form 1370 representing the ENBL signal provided at output 734 of gate 720.

During a first time interval 1371, the wave forms 1352–1370 of the depicted timing diagram represent the behavior of the processing signals of the ON/OFF announce sub-circuit 680 (FIG. 10) in response to an OFF to ON transition (arming) of the pool alarm system, wherein synthesizer 84 (FIG. 6) generates a single beep sound. During a second time interval 1372, wave forms 1352–1370 of the depicted timing diagram represent the behavior of the processing signals of the ON/OFF announce sub-circuit 680 (FIG. 10) in response to an ON to OFF transition (disarming) of the pool alarm system, wherein synthesizer 84 (FIG. 6) generates two beep sounds.

At time 1373, at the beginning of the first time interval 1371, the ON signal, (wave form 1352) switches HI. At a time 1374, after the ON signal transitions HI, flip-flop 1150 (FIG. 10) is set by the next positive going transition of the CLK0 signal (not shown) and accordingly, the OND signal (wave form 1354) provided at output 1172 of flip-flop 1150 (FIG. 10) switches from LO to HI. During the short time period between time 1373 and time 1374, while the ON signal (wave form 1352) is HI, and the OND signal (wave form 1354) is LO, the potential at the inverted input 1228 of gate 1166 (FIG. 10) is LO, and the CCLR signal (wave form 1356) which is provided at output 1229 of gate 1166 (FIG. 10) is HI. As described above, the CCLR signal is provided to counter 608 (FIG. 6), shift register 780 (FIG. 7A), up-down counter 944 (FIG. 7A) for reset purposes. After the OND signal (wave form 1354) switches HI at time 1374, flip-flops 1152, 1154, and 1156 (FIG. 10) are successively set by the next three positive going transitions of the 2 Hz signal (wave form 1358) and accordingly, the OND2 signal (wave form 1362), OND3 signal (wave form 1364), and OND4 signal (wave form 1366) provided at outputs 1180, 1188, and 1196 of the flip-flops 1152, 1154, and 1158 switch from LO to HI at times 1376, 1380 and 1382 respectively. At time 1376, while the OND3 signal is LO, the OND signal is HI, and the 2 Hz signal is HI, the ONBEEP signal (wave form 1368) provided at output 1220 of gate 1162 (FIG. 10) transitions from HI to LO. In response to the ONBEEP signal (wave form 1368) transitioning from HI to LO, the ENBL signal (wave form 1370), provided at output 734 (FIG. 6) of gate 720, transitions from LO to HI. At time 1378, the 2 Hz signal (wave form 1358) transitions from HI to LO and the ONBEEP signal (wave form 1368) transitions from LO to HI causing the ENBL signal (wave form 1370) to transition from HI to LO.

During the second time interval 1372, wave forms 1352–1370 of the depicted timing diagram represent the behavior of the processing signals of the ON/OFF announce sub-circuit 680 (FIG. 10) in response to an ON to OFF transition (disarming) of the pool alarm system, wherein synthesizer 84 generates two beep sounds. At time 1384, at the beginning of the second time interval 1372, the ON signal, (wave form 1352) switches from HI to LO. At a time 1386, after the ON signal transitions LO, flip-flop 1150 (FIG. 10) is cleared by the next positive going transition of the CLK0 signal (not shown) and accordingly, the OND signal (wave form 1354) provided at output 1172 of flip-flop 1150 (FIG. 10) switches from HI to LO. During the short time period between time 1384 and time 1386, while the ON signal (wave form 1352) is LO, and the OND signal (wave form 1354) is HI, the potential at the inverted input 1226 of gate 1166 (FIG. 10) is LO, and the CCLR signal (wave form 1356) which is provided at output 1229 of gate 1166 (FIG. 10) is HI. After the OND signal (wave form 1354) switches LO at time 1386, flip-flops 1152, 1154, and 1156 (FIG. 10) are successively cleared by the next three positive going transitions of the 2 Hz signal (wave form 1358) and accordingly, the OND2 signal (wave form 1362), OND3 signal (wave form 1364), and OND4 signal (wave form 1366) provided at outputs 1180, 1188, and 1196 of the flip-flops 1152, 1154, and 1158 switch from HI to LO at times 1388, 1392 and 1396 respectively. Between times 1388 and 1394: the OND4 signal (wave form 1364), provided at input 1224 of gate 1164 (FIG. 10), is HI; and the OND/ signal (inverted wave form 1352), provided at input 1223 of gate 1164 (FIG. 10), is HI. During this time period, the 2 Hz signal transitions HI at times 1388 and 1392 , and the OFFBEEP signal (wave form 1368) provided at output 1220 of gate 1162 (FIG. 10) transitions from HI to LO twice. In response to the OFFBEEP signal (wave form 1368) transitioning from HI to LO, the ENBL signal (wave form 1370), provided at output 734 (FIG. 6) of gate 720, transitions from LO to HI driving the audio circuit to provide two audible sounds.

Figure 14:
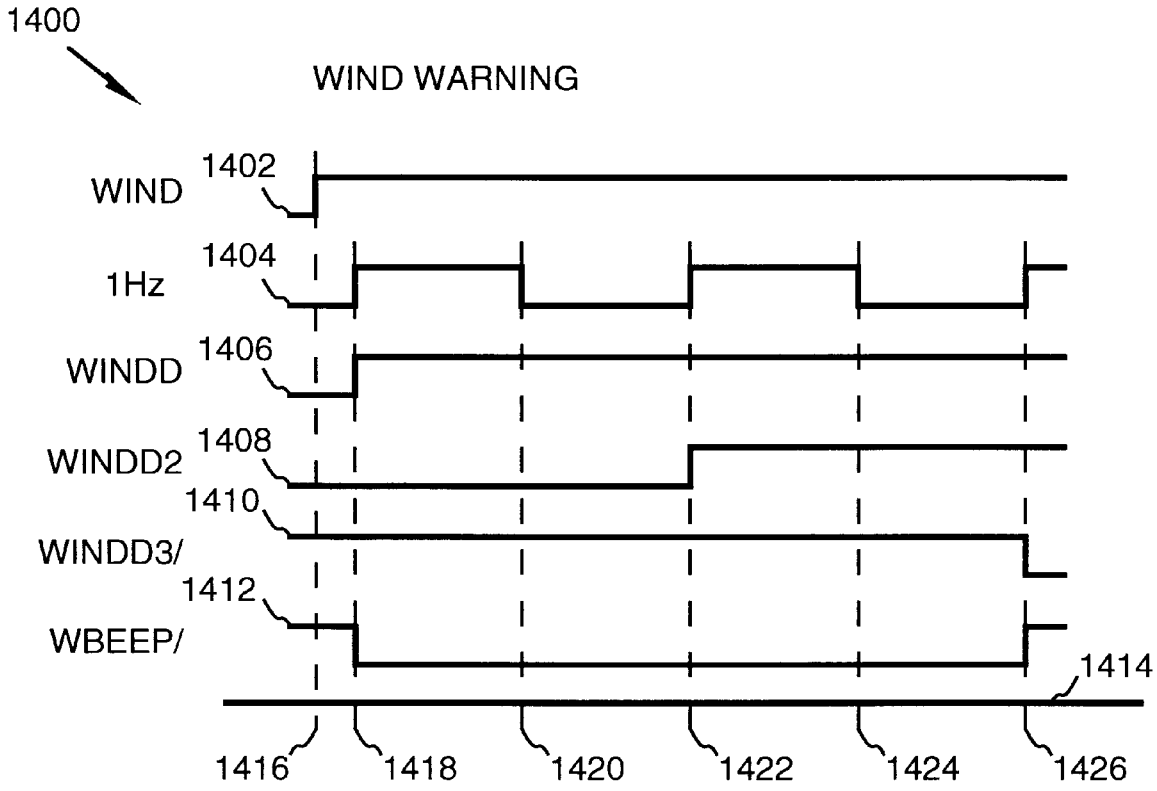
FIG. 14 is a timing diagram illustrating operation of the wind warning sub-circuit of FIG. 11.

FIG. 14 shows a timing diagram at 1400 illustrating operation of the wind warning circuit 708 (FIG. 11) in response to the WIND signal, provided at input 712 of circuit 708, transitioning from LO to HI. The depicted timing diagram includes: a wave form 1402 representing the WIND signal provided at the input 1232 (FIG. 11) of flip-flop 1230; a wave form 1404 representing the 1 Hz signal provided at clock input 1234 (FIG. 11) of flip-flop 1230; a wave form 1406 representing the WINDD signal provided at output 1238 of flip-flop 1230; a wave form 1408 representing the WINDD2 signal provided at output 1248 of flip-flop 1242; a wave form 1410 representing the inverted WINDD3/ signal provided at inverted output 1258 of flip-flop 1251; and a wave form 1412 representing the WBEEP/ signal provided at output 1266 of gate 1260 of the wind warning circuit. At a time 1402, the WIND signal (wave form 1402) provided at data input 1232 of flip-flop 1230 transitions from LO to HI, and at a subsequent time 1418, the 1 Hz signal (wave form 1404) transitions from LO to HI setting flip-flop 1230 causing the WINDD signal (wave form 1406) to transition from LO to HI. At a time 1422, the WINDD signal (wave form 1406) provided at data input 1244 of flip-flop 1242, is HI, and flip-flop 1242 is set upon a positive going transition of the 1 Hz signal (wave form 1404). At a time 1426, the WINDD2 signal (wave form 1408), received at data input 1252 of flip-flop 1251, is HI, and flip-flop 1251 is set upon a next positive going transition of the 1 Hz signal (wave form 1404). When flip-flop 1251 is set, the WINDD3/ signal provided at the inverted output 1258 of flip-flop 1251 transitions HI, and with the WINDD signal (wave form 1406) still HI, the inverted WBEEP/ signal (wave form 1412), provided by gate 1260, transitions HI.

Figure 15A:
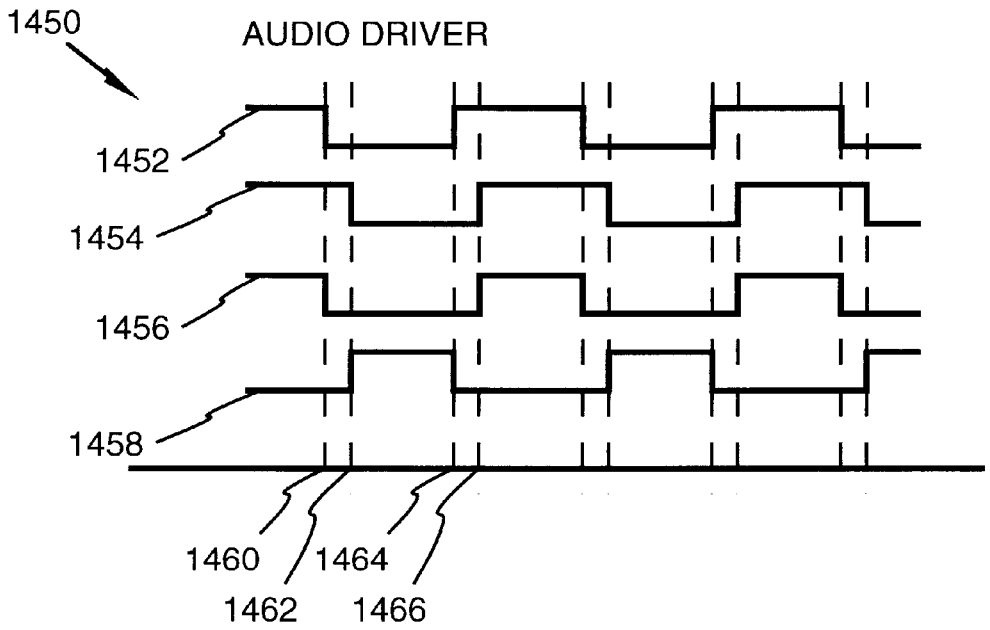
FIG. 15A is a timing diagram illustrating operation of the audio driver sub-circuit of FIG. 8.

FIG. 15A shows a timing diagram at 1450 illustrating operation of the audio driver circuit 644 of FIG. 8. The depicted timing diagram includes: a wave form 1452 representing the output of the transistor 1040 of the audio driver circuit; a wave form 1454 representing the output of the transistor 1048 of the audio driver circuit; wave form 1456 representing the output of the transistor 1056 of the audio driver circuit; and a wave form 1458 representing the output of the transistor 1064 of the audio driver circuit. As illustrated at times 1460 and 1462, wave forms 1452 and 1456 (representing the outputs of transistors 1040 and 1056 of FIG. 8) transition from HI to LO before wave forms 1454 and 1458 (representing the outputs of transistors 1048 and 1064 of FIG. 8) transition from LO to HI. As illustrated at times 1464 and 1466, wave forms 1452 and 1456 (representing the outputs of transistors 1040 and 1056 of FIG. 8) transition from LO to HI before wave forms 1454 and 1458 (representing the outputs of transistors 1048 and 1064 of FIG. 8) transition from HI to LO.

Figure 15B:
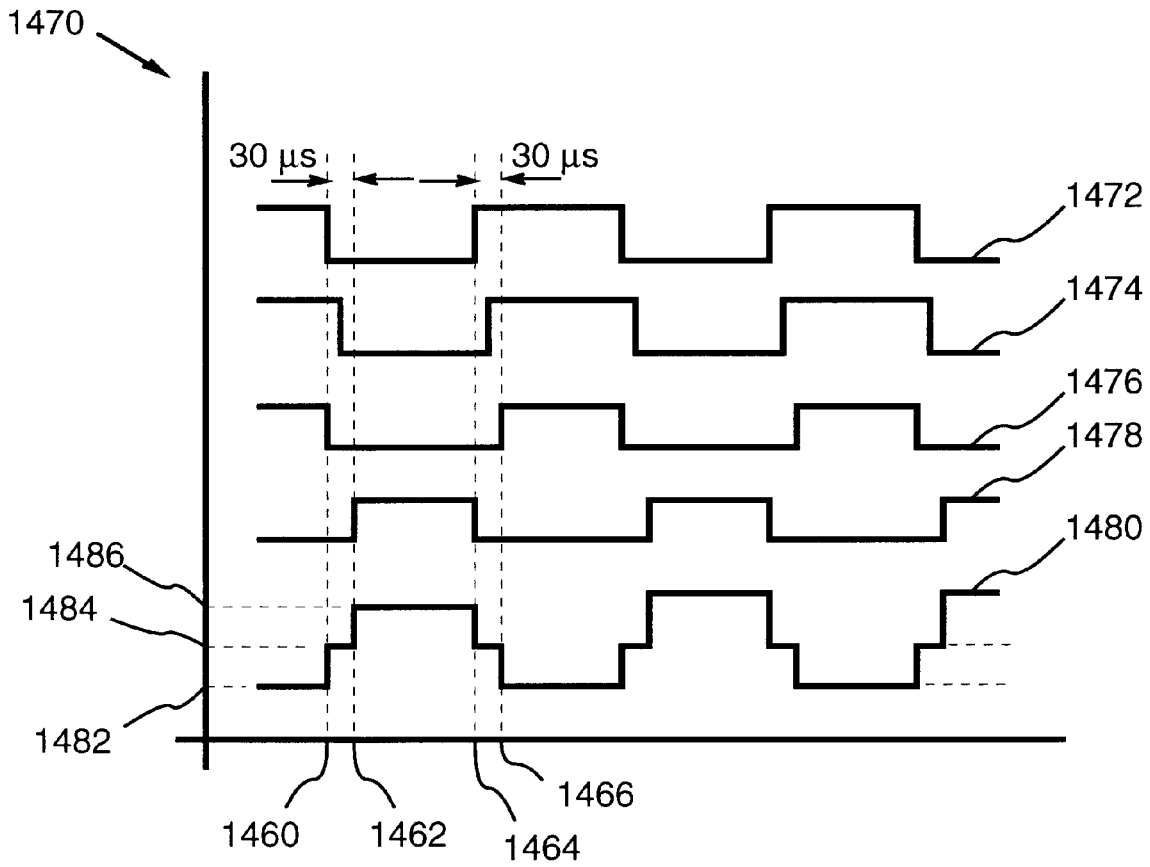
FIG. 15B is a timing diagram illustrating further aspects of operation of the audio driver subcircuit of FIG. 8.

FIG. 15B shows a timing diagram at 1470 illustrating further aspects of operation of the audio driver circuit 644 of FIG. 8. The depicted timing diagram includes a wave form 1472 representing a signal provided at output 976 of flip-flop 970 (FIG. 8); a wave form 1474 representing a signal provided at output 986 of flip-flop 980 (FIG. 8); a wave form 1476 representing a signal provided at output 996 of gate 990; a wave form 1478 representing a signal provided at output 1004 of gate 998; and a wave form 1480 representing an AUDIO1–AUDIO2 signal provided across outputs 652 and 654 of the audio driver circuit of FIG. 8. Prior to the time 1460 (FIG. 15A), transistors 1048 and 1064 (FIG. 8) are ON and transistors 1040 and 1056 (FIG. 8) are OFF causing the AUDIO1–AUDIO2 signal (wave form 1480) to be at a first signal level 1482. At time 1460, wave forms 1472 and 1476 both transition from HI to LO, causing wave form 1480 to transition from the first signal level 1482 to a second signal level 1484 in which all of transistors 1040. 1048, 1056, and 1064 (FIG. 8) are OFF. At time 1462, 30 $\mu$S after time 1460, wave form 1474 transitions from HI to LO, and wave form 1478 transitions from LO to HI, thereby causing wave form 1480 to transition from the second signal level 1484 to a third signal level 1486 for which transistors 1040 and 1056 (FIG. 8) are ON while transistors 1048 and 1064 are OFF. At time 1464, wave form 1472 transitions from LO to HI while wave form 1478 transitions from HI to LO, thereby causing wave form 1480 to transition from the third signal level 1486 back to the second signal level 1484. At time 1466, 30 $\mu$S after time 1464, wave forms 1474 and 1476 both transition from LO to HI, thereby causing wave form 1480 to transition from the second signal level 1484 to the first signal level 1482.

Figure 16:
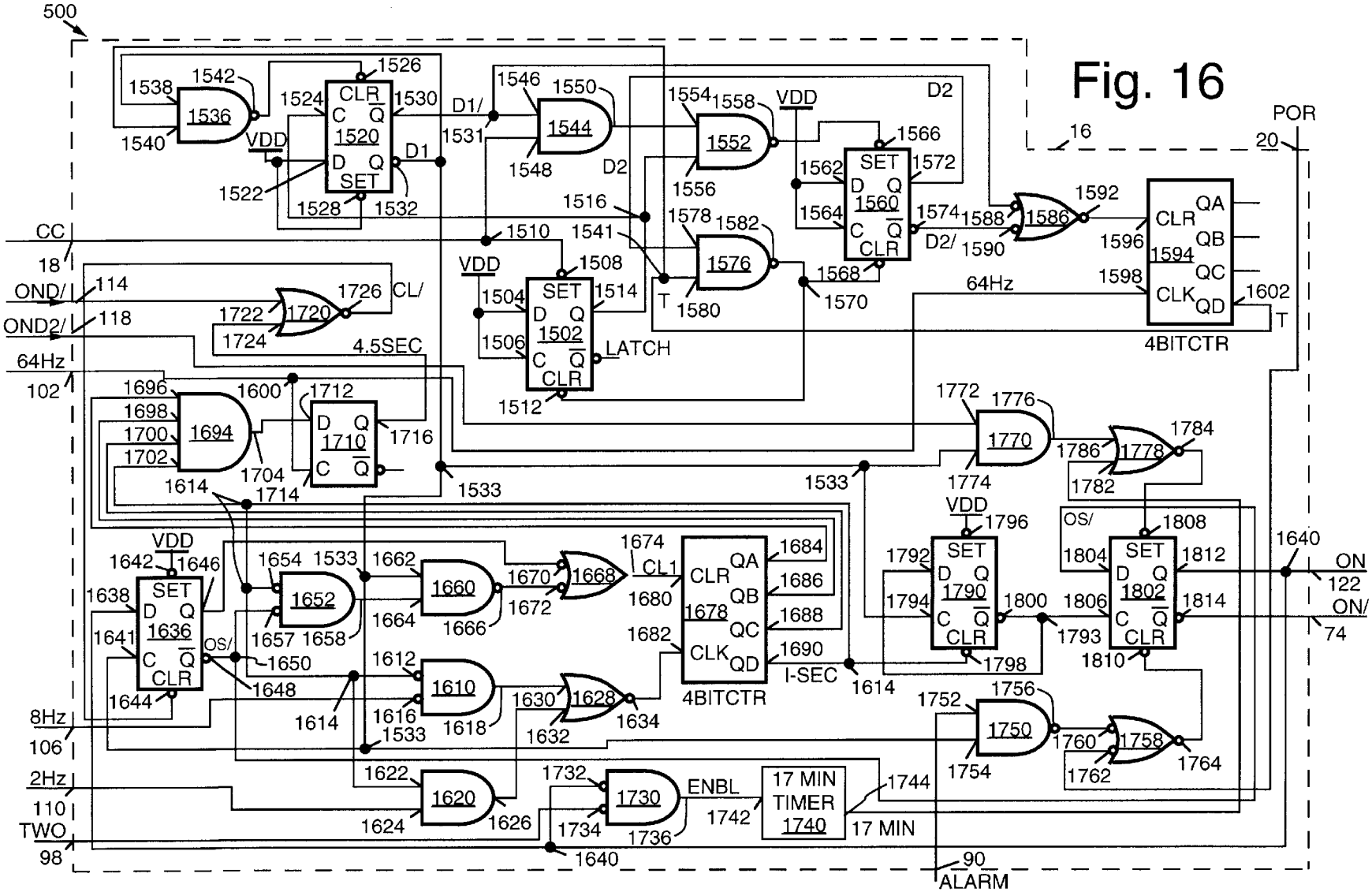
FIG. 16 is a detailed schematic circuit diagram of the ON/OFF control circuit of FIG. 1.

FIG. 16 shows a detailed schematic diagram at 1500 of the ON/OFF control circuit 16 of FIG. 1. The circuit 16 comprises a contact denounce portion including: a flip-flop 1502 having a data input 1504 and a clock input 1506 both coupled to VDD, an inverted asynchronous set input 1508 connected to receive the CC signal from the ON/OFF switch 182 (FIG. 1) via input 18 of the ON/OFF control circuit and a node 1510, an inverted asynchronous clear input 1512, and an output 1514 coupled to provide a LATCH signal to a node 1516; a flip-flop 1520 having a data input 1522 connected to VDD, a clock input 1524 connected to receive the LATCH signal from output 1514 of flip-flop 1502 via node 1516, an inverted asynchronous clear input 1526, an inverted asynchronous set input 1528 connected to VDD, an inverted output 1530 coupled to provide an inverted D1/ signal to a node 1531, and an output 1532 providing a D1 signal to a node 1533; a NAND gate 1536 having an input 1538 connected to receive the D1 signal from output 1532 of flip-flop 1520 via node 1533, an input 1540 connected to receive a T signal via a node 1541, and an output 1542 connected to the asynchronous clear input 1526 of flip-flop 1520; an AND gate 1544 having an input 1546 connected to receive the inverted D1/ signal from inverted output 1530 of flip-flop 1520 via node 1531, an input 1548 connected to receive the CC signal via input 18 of circuit 16 and node 1510, and an output 1550; a NAND gate 1552 having an input 1554 connected to output 1550 of AND gate 1544, an input 1556 connected to receive the LATCH signal from output 1514 of flip-flop 1502 via node 1516, and an output 1558; a flip-flop 1560 having a data input 1562 and a clock input 1564 both connected to VDD, an inverted asynchronous set input 1566 connected to output 1558 of NAND gate 1552, an inverted asynchronous clear input 1568 connected to a node 1570, an output 1572 providing a D2 signal, and an inverted output 1574 providing an inverted D2/ signal; a NAND gate 1576 having an input 1578 connected to receive the D2 signal from output 1572 of flip-flop 1560, an input 1580 connected to receive the T signal via node 1541, and an output 1582; an OR gate 1586 having an inverted input 1588 connected to receive the inverted D1/ signal from output 1530 of flip-flop 1520 via node 1531, an inverted input 1590 connected to receive the inverted D2/ signal from inverted output 1574 of flip-flop 1560, and an inverted output 1592; a four-bit counter 1594 having a clear input 1596 connected to output 1592 of gate 1586, an inverted clock input 1598 connected to receive the 64 Hz signal from input 102 of circuit 16, and a fourth-bit output 1602 providing the T signal to node 1541.

The ON/OFF circuit 16 also includes: an AND gate 1610 having an inverted input 1612 connected to receive a 1-SEC signal via a node 1614, an inverted input 1616 connected to receive the 8 Hz signal via input 106 of circuit 16, and an output 1618; an AND 1620 having an input 1622 connected to receive the 1-SEC signal via node 1614, an input 1624 connected to receive the 2 Hz signal via input 110 of circuit 16, and an output 1626; a NOR gate 1628 having an input 1630 connected to output 1618 of gate 1610, an input 1632 connected to output 1626 of gate 1620, and an output 1634; a flip-flop 1636 having a data input 1638 connected to receive the ON signal via a node 1640, a clock input 1641 connected to receive the D1 signal from output 1532 of flip-flop 1520 via node 1533, an inverted asynchronous set input 1642 connected to VDD, an inverted asynchronous clear input 1644 connected to receive an inverted CL/ signal, an output 1646 providing a Q signal, and an inverted output 1648 providing an inverted OS/ signal to a node 1650; an AND gate 1652 having an inverted input 1654 connected to receive the 1-SEC signal via node 1614, an inverted input 1657 connected to receive the inverted OS/ signal from inverted output 1648 of flip-flop 1636, and an output 1658; a NAND gate 1660 having an input 1662 connected to receive the D1 signal via node 1533, an input 1664 connected to output 1658 of gate 1652, and an output 1666; an OR gate 1668 having an inverted input 1670 coupled to receive the Q signal from output 1646 of flip-flop 1636, an inverted input 1672 connected to output 1666 of gate 1660, and an output 1674 providing a CL1 signal; a four-bit counter 1678 having a clear input 1680 connected to receive the CL1 signal from output 1674 of gate 1668, an inverted clock input 1682 connected to output 1634 of gate 1628, a first-bit output 1684, a second-bit output 1686, a third-bit output 1688, and a fourth-bit output 1690 connected to provide the 1-SEC signal to node 1614; an AND gate 1694 having an input 1696 connected to 1684 of counter 1678, a second input 1698 connected to output 1686 of counter 1678, a third-input 1700 connected to output 1686 of counter 1678, and an input 1702 connected to receive the 1-SEC signal from output 1690 of counter 1678 via node 1614, and an output 1704; a flip-flop 1710 having a data input 1712 connected to output 1704 of AND gate 1694, a clock input 1714 connected to receive the 64 Hz signal from input 102 of circuit 16 via node 1600, an output 1716 providing a 4.5-SEC signal; a NOR gate 1720 having an input 1722 connected to receive the OND/ signal via input 114 of circuit 16, an input 1724 connected to receive the 4.5-SEC signal from output 1716 of flip-flop 1710, and an output 1726 connected to provide the inverted CL/ signal to the asynchronous clear input 1644 of flip-flop 1636.

The ON/OFF circuit 16 further includes: an AND gate 1730 having an inverted input 1732 connected to receive the ON signal via node 1640, an inverted input 1734 connected to receive the TWO signal via input 98 of circuit 16, and an output 1736 providing a timer enable signal; a timer 1740 having an enable input 1742 connected to output 1736 of gate 1730, and an output 1744 providing a 17-MIN signal; a NAND gate 1750 having an input 1752 connected to receive the ALARM signal via input 90 of circuit 16, an input 1754 connected to receive the D1 signal via node 1533, and an output 1756; an OR gate 1758 having an inverted input 1760 connected to output 1756 of gate 1750, an inverted input 1762 connected to receive the power on reset signal (POR signal) from voltage monitor circuit 14 (FIG. 1) via input 20 of circuit 16, and an inverted output 1764; an AND gate 1770 having an input 1772 connected to receive the OND2/ signal via input 118 of circuit 16, an input 1774 connected to receive the D1 signal from output 1532 of flip-flop 1520 via node 1533, and an output 1776; a NOR gate 1778 having an input 1780 connected to output 1776 of AND gate 1770, an input 1782 connected to receive the 17-MINI signal from output 1744 of timer 1740, and an output 1784; a flip-flop 1790 having a data input 1792 connected to a node 1793, a clock input 1794 connected to receive the D1 signal via node 1533, an inverted asynchronous set input 1796 connected to VDD, an inverted asynchronous clear input 1798 connected to receive the 1-SEC signal from output 1690 of counter 1678, and an inverted output 1800 connected to provide an inverted Q/ signal to data input 1792 of flip-flop 1790 via node 1793; a flip-flop 1802 having a data input 1804 connected to receive the inverted OS/ signal from inverted output 1648 of flip-flop 1636, a clock input 1806 connected to receive the Q/ signal from the inverted output 1800 of flip-flop 1790, an inverted asynchronous set input 1808 connected to output 1784 of gate 1778, an inverted asynchronous clear input 1810 connected to output 1764 of gate 1758, an output 1812 providing the ON signal to output 122 of circuit 16 via node 1640, and an inverted output 1814 connected to provide the inverted ON/ signal to output 74 of circuit 16.

The mode (armed or disarmed) in which the pool alarm system is operating is determined by the state of flip-flop 1802. If flip-flop 1802 is set, the ON signal is HI and the system is armed. If flip-flop 1802 is cleared, the ON signal is LO and the system is disarmed. If the pool alarm system is disarmed (the ON signal is LO), a single closure of switch 182 (FIG. 1) will arm the system by setting flip-flop 1802 via gates 1770 and 1778.

The requirements for disarming the system depends on the system status. If the alarm condition is active (the ALARM signal is HI), only a single closure of switch 182 (FIG. 1) is required to turn the system OFF via gates 1750 and 1758. If the alarm condition is not active (the ALARM signal is LO), a child proof disarming procedure is required as further explained below. When batteries are installed, the power on reset signal (POR signal) transitions HI clearing flip-flop 1802 via gate 1758. Therefore, when batteries are installed, the system is disarmed.

When the pool alarm system is disarmed, the alarm system continues to monitor wave disturbances while it chirps twice at the end of every preset warning period, as described above. If the system 10 (FIG. 1) is disarmed and a period of 17 minutes elapses during which the processor 58 (FIG. 1) does not detect two waves during a count interval (the TWO signal remains LO), the system automatically arms itself. Timer 1740 is enabled when the TWO signal is LO and the ON signal is LO. If the TWO signal does not transition to the HI state for 17 minutes (no more than two waves are detected within a count interval) timer 1740 will arm the system by setting flip-flop 1802 via gate 1778.

Figure 17:
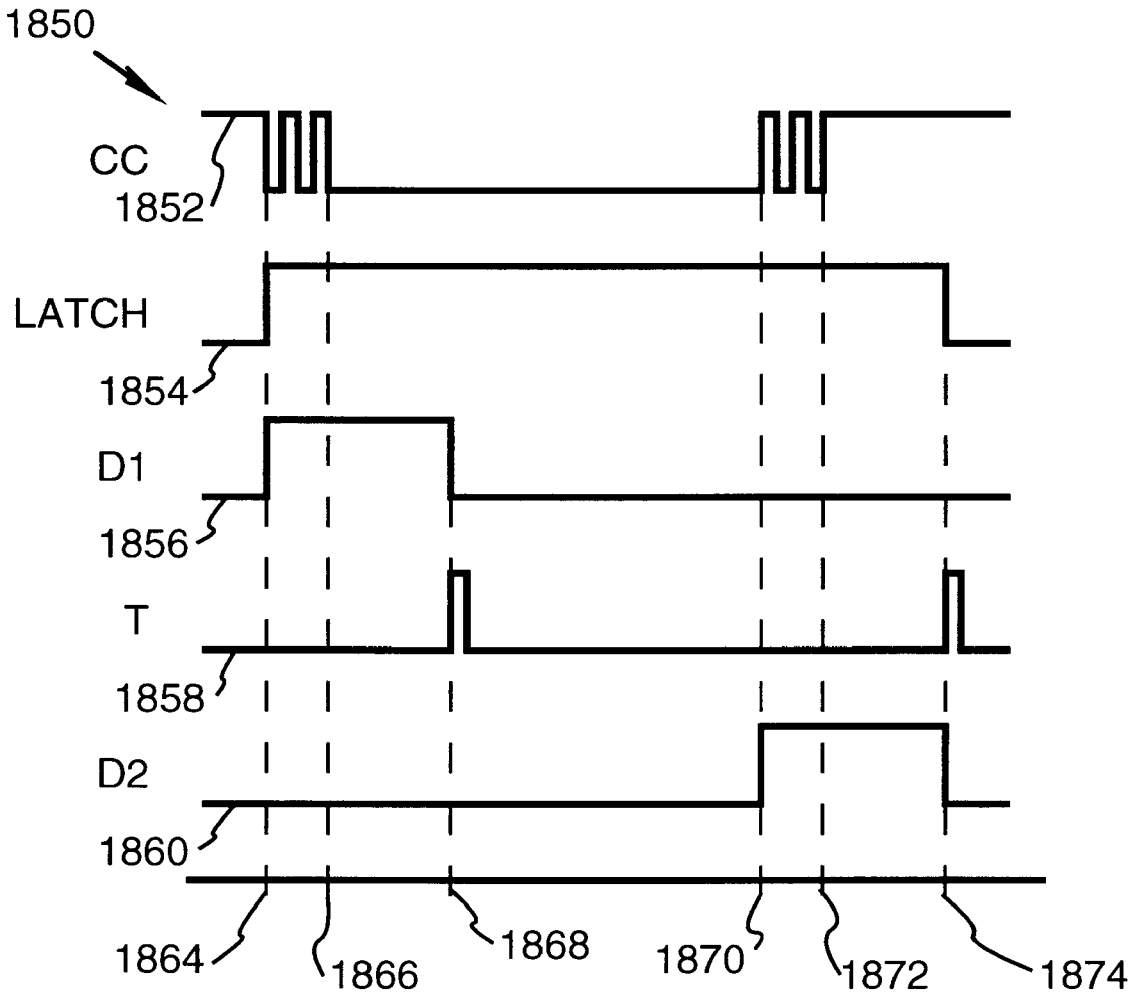
FIG. 17 is a timing diagram illustrating operation of a contact debounce function of the ON/OFF control circuit of FIG. 16.

FIG. 17 shows a timing diagram at 1850 illustrating a contact debounce function of the ON/OFF control circuit 16 (FIG. 16). The depicted timing diagram includes: a wave form 1852 representing the CC signal generated by a closure of switch 182 (FIG. 1), and received at input 18 of circuit 16 (FIG. 16); a wave form 1854 representing the LATCH signal provided at output 1514 of flip-flop 1502 of the ON/OFF control circuit 16 (FIG. 16); a wave form 1856 representing the D1 signal provided at output 1532 of flip-flop 1520 (FIG. 16); a wave form 1858 representing the T signal provided at output 1602 of counter 1594 (FIG. 16); and a wave form 1860 representing the D2 signal provided at output 1572 of flip-flop 1560 (FIG. 16).

At a time 1864, the CC signal (wave form 1852), which is received at asynchronous set input 1508 (FIG. 16) of flip-flop 1502, transitions from HI to LO in response to a contact closure of ON/OFF switch 182 (FIG. 1) by a user, thereby setting flip-flop 1502 (FIG. 16). When flip-flop 1502 (FIG. 16) is set, the LATCH signal (wave form 1854), provided from output 1514 of flip-flop 1502 to clock input 1524 of flip-flop 1520, transitions from LO to HI thereby setting flip-flop 1520. When flip-flop 1520 (FIG. 16) is set, the D1 signal (wave form 1856), provided at output 1532 of flip-flop 1520, transitions from LO to HI and counter 1594 is set by the inverted D1/ signal (inverted wave form 1856) received at its clear input 1596 via gate 1586. Between time 1864 and a time 1866, the CC signal (wave form 1852) bounces between the HI and LO logic voltage levels. At a time 1868, 125 milliseconds after time 1864, counter 1594 (FIG. 16) reaches a count of eight (1111) and the T signal (wave form 1858), provided at output 1602 of counter 1594, pulses HI clearing flip-flop 1520 (FIG. 16) via gate 1536 causing the D1 signal (wave form 1856) to transition from HI back to LO. Between time 1868 and a time 1870, switch 182 (FIG. 1) is held closed by the user and the CC signal (wave form 1852) remains LO. At time 1870, switch 182 (FIG. 1) is released by the user and the CC signal (wave form 1852) bounces from LO to HI, settling at a time 1872 in the HI state. Between time 1870 and a time 1872, the CC signal (wave form 1852) bounces between the HI and LO logic voltage levels. At time 1870, with the D1 signal (wave form 1856) LO, the transition from LO to HI of the CC signal (wave form 1852), provided at asynchronous set input 1566 (FIG. 16) of flip-flop 1560 via gates 1544 and 1552, sets flip-flop 1560 causing the D2 signal (wave form 1860) to transition from LO to HI. Also at time 1870, the inverted D2/ signal (wave form 1860 inverted), provided by output 1574 of flip-flop 1560 (FIG. 16) enables counter 1594. At a time 1874, 125 milliseconds after time 1870, counter 1594 (FIG. 16) reaches a count of eight (1111) and the T signal (wave form 1858), provided at output 1602 of counter 1594, pulses HI clearing flip-flop 1502 and flip-flop 1560 via gate 1576 causing the LATCH signal (wave form 1854), provided at output 1514 of flip-flop 1502 to transition from HI to LO. The contact debounce function of the ON/OFF control circuit provide a digital on-shot which controls the signal D1 (wave form 1856) which is used in arming and disarming the pool alarm system as further explained below.

Figure 18:
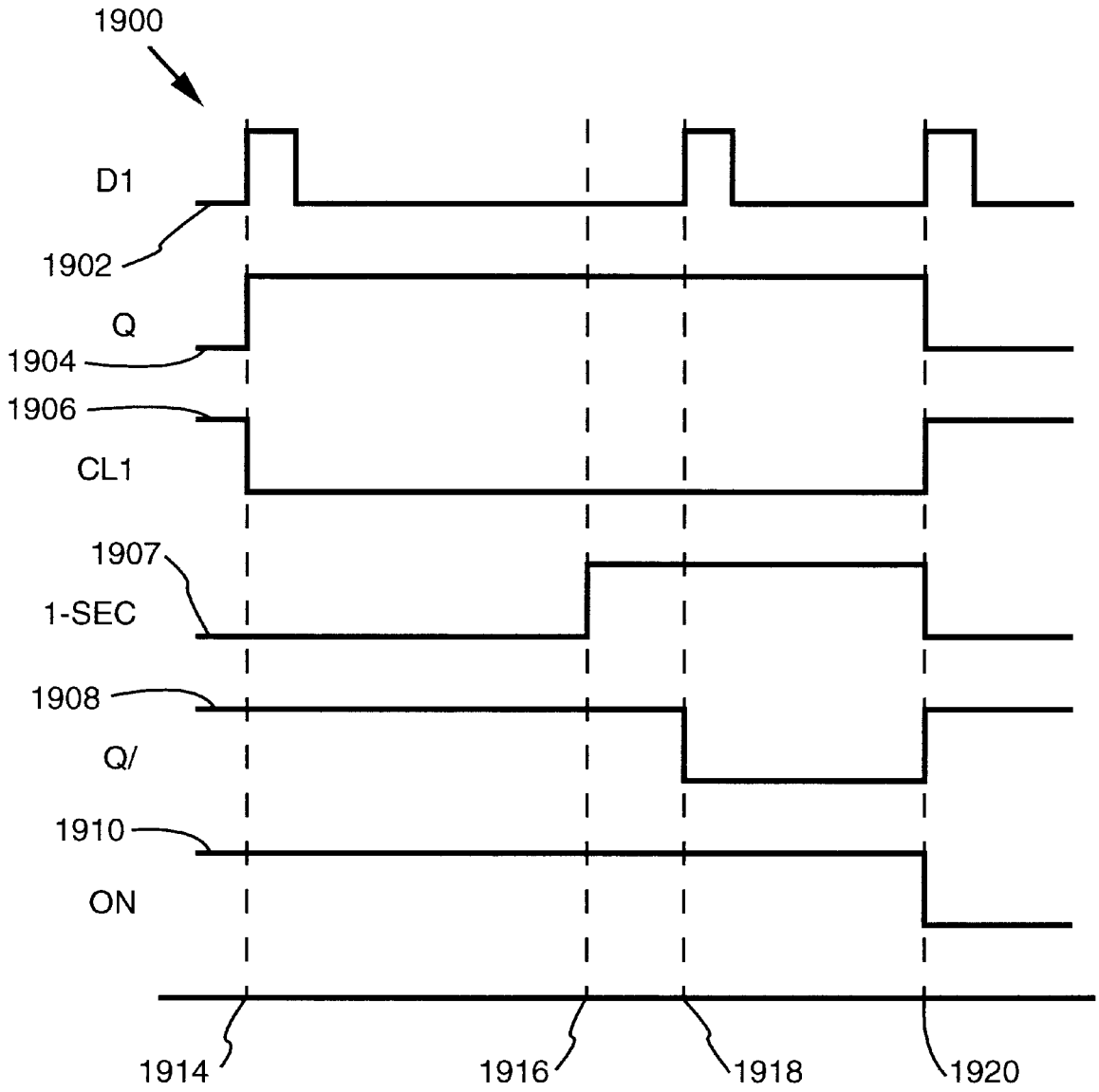
FIG. 18 is a timing diagram illustrating operation of a disarming sequence function of the ON/OFF control circuit of FIG. 16.

FIG. 18 shows a timing diagram at 1900 illustrating operation of a disarming sequence, or turn-off sequence, required by the ON/OFF control circuit 16 (FIG. 16) when the system is armed and the ALARM condition is not activated (the ALARM signal, received at input 90 of circuit 16, is LO). The depicted timing diagram includes: a wave form 1902 representing the D1 signal provided at output 1532 of flip-flop 1520 (FIG. 16) in response to a closure of switch 182 (FIG. 1) as described above; a wave form 1904 representing the Q signal provided at output 1646 of flip-flop 1636 (FIG. 16); a wave form 1906 representing the CL1 signal provided to input 1680 of counter 1678 (FIG. 16); a wave form 1907 representing the 1-SEC signal provided at output 1690 of counter 1678 (FIG. 16); a wave form 1908 representing the inverted Q/ signal provided at inverted output 1800 of flip-flop 1790 (FIG. 16); and a wave form 1910 representing the system status signal, (ON signal) provided at output 1812 of flip-flop 1802 (FIG. 16). The disarming sequence requires an initial closure of switch 182 (FIG. 1) to begin the sequence, followed by two successive closures after waiting at least one second following the initial contact closure. The disarming sequence provides protection against young children disarming the pool alarm system in order to enter the pool without supervision and without setting the alarm off.

At a time 1914, the ON signal (wave form 1910), provided at data input 1638 of flip-flop 1636 (FIG. 16), is HI indicating that the pool alarm system 10 (FIG. 1) is initially armed. At time 1914, the D1 signal (wave form 1902), provided at clock input 1641 (FIG. 16) of flip-flop 1636 transitions from LO to HI setting flip-flop 1636, and causing the Q signal (wave form 1904), provided at its output 1646 to transition from LO to HI which causes the CL1 signal (wave form 1906), which is provided to the clear input 1680 of counter 1678 via gate 1668, to transition from HI to LO thereby enabling counter 1678 which acts as a 1 second timer.

At time 1916, approximately 1 second after time 1914, counter 1678 reaches a count of 8, and the 1-SEC signal (wave form 1907) provided by output 1688 of counter 1678, and applied to the asynchronous clear input 1798 of flip-flop 1790, transitions from LO to HI. A second closure of the ON/OFF switch 182 (FIG. 1) prior to the end of the 1 second interval (before the 1 second interval, not illustrated in the depicted timing diagram) would reset counter 1678 via gates 1660 and 1668 and start the 1 second interval over. The end of the 1 second interval also changes the clock rate of counter 1678 from 8 Hz to 2 Hz via gates 1610, 1620, and 1628. This allows another 3.5 seconds to complete the disarming sequence. If counter 1678 (FIG. 16) reaches a count of 15 before the sequence is completed, gate 1694 sets flip-flop 1710 which clears flip-flop 1636 via gate 1720 and the sequence is aborted. If the entire disarming sequence is not completed within four and a half seconds, flip-flop 1636 is cleared by the OND/ signal via gate 1720.

Immediately before a time 1918 (which is well within the 3.5 second period following time 1916), the 1-SEC signal (wave form 1907) is HI, and the Q/ signal (wave form 1908), provided from inverted output 1800 of flip-flop 1790 to data input 1792 of flip-flop 1790, is also HI. At time 1918, the D1 signal (wave form 1902) transitions from LO to HI in response to a second closure of the ON/OFF switch 182 (FIG. 1), thereby setting flip-flop 1790 and causing the inverted Q/ signal (wave form 1908), provided at the inverted output 1800 of flip-flop 1790, to transition from HI to LO. Immediately before a time 1920, the 1-SEC signal (wave form 1907) is HI, and the Q/ signal (wave form 1908), provided from inverted output 1800 of flip-flop 1790 to data input 1792 of flip-flop 1790, is LO. At time 1920, the D1 signal (wave form 1902) transitions from LO to HI in response to a third closure of the ON/OFF switch 182 (FIG. 1) thereby clearing flip-flop 1790 and causing the inverted Q/ signal (wave form 1908), provided at the inverted output 1800 of flip-flop 1790, to transition from LO to HI. The rising edge of the inverted Q/ signal (wave form 1908), provided from inverted output 1798 of flip-flop 1790 to clock input 1806 of flip-flop 1802, clears flip-flop 1802 thereby causing the ON signal (wave form 1910), provided at output 1812 of flip-flop 1802, to transition from HI to LO in order to disarm the pool alarm system.

It will be readily understood by those skilled in the art that the above described method of analyzing wave motion, performed by the logical circuits of the pulse width discriminator 52 (FIG. 2), processor 58 (FIG. 3), synthesizer 84 (FIG. 6), and ON/OFF control circuit 16 (FIG. 16), may also be implemented by code stored on a computer readable medium and executed by a processor.

Figure 19:
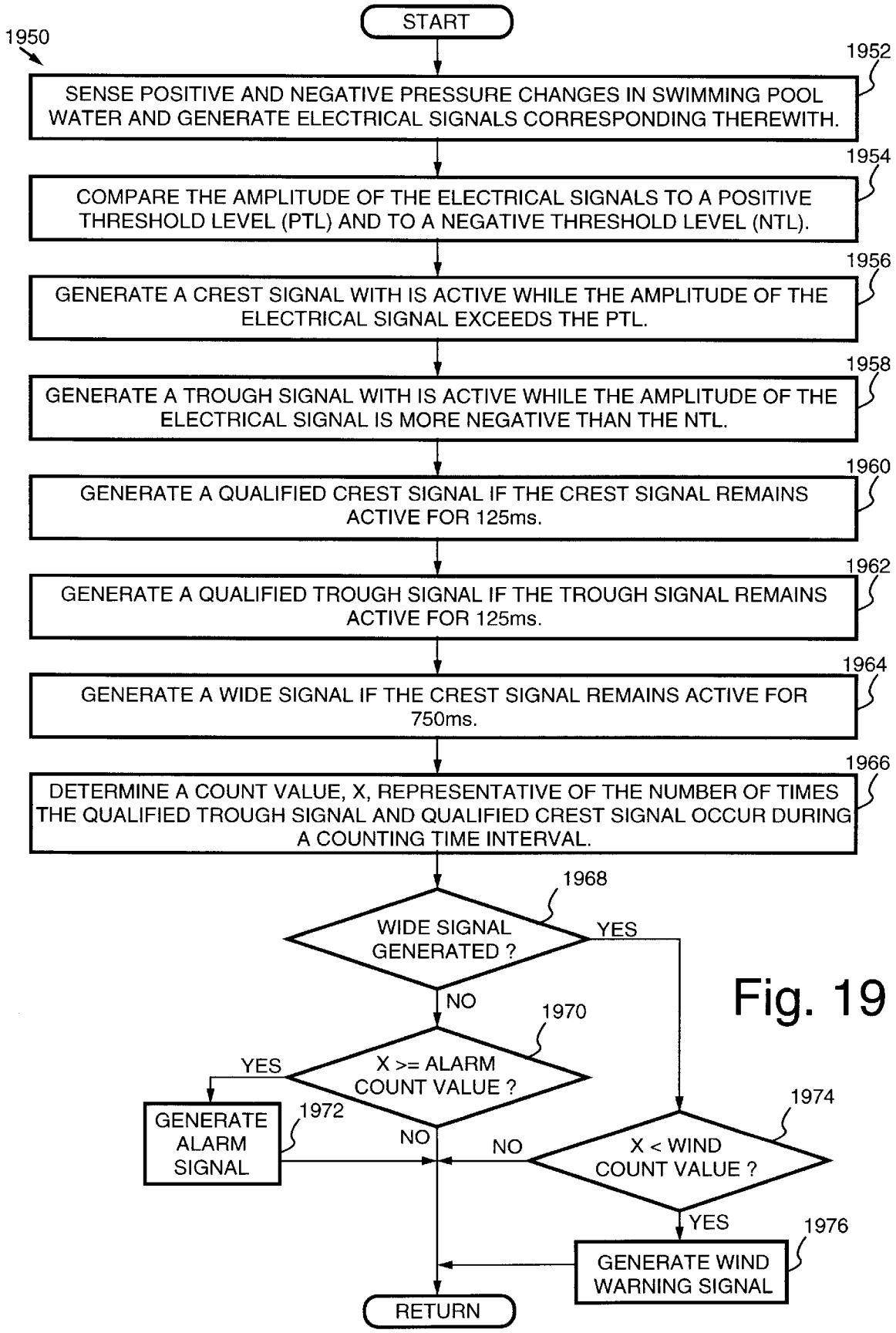
FIG. 19 is a flow chart depicting a wave motion analysis process in accordance with the present invention.

FIG. 19 shows a flow chart depicting generally at 1952 a wave motion analysis process in accordance with the present invention which may be implemented as code executed by a processor in order to achieve the same basic function as the logic circuits described above. The depicted process begins with step 1952 in which positive and negative pressure changes are sensed by transducer 22 (FIG. 1) in the swimming pool water and electrical signals corresponding therewith are generated. In step 1954, the amplitude of the electrical signals are compared to a positive threshold level (PTL), and to a negative threshold level (NTL). In step 1956, a crest signal is generated which is active while the amplitude of the electrical signal exceeds the positive threshold level. In step 1958, a trough signal is generated which is active while the amplitude of the electrical signal is more negative than the negative threshold level. In step 1960, a qualified crest signal is generated if the crest signal remains active for 125 ms, and in step 1962, a qualified trough signal is generated if the trough signal remains active for 125 ms. In step 1964 a wide signal is generated if the crest signal remains active for 750 ms. In step 1966 a count value, X, is determined, the count value, X, being representative of the number of times the qualified trough signal and qualified crest signal occur during a counting time interval. The process proceeds from step 1966 to 1968 at which it is determined whether the wide signal has been generated. If it is determined at 1968 that the wide signal has not been generated, the depicted process proceeds to 1970 at which it is determined whether the count value, X, is greater than or equal to an alarm count value. If it is determined at 1970 that the count value, X, is greater than the alarm count value, the depicted process proceeds to step 1972 in which an alarm signal is generated. If it is determined at 1970 that the count value, X, is not greater than the alarm count value, the depicted process returns to start. If it is determined at 1968 that the wide signal is generated, the depicted process proceeds to 1974 at which it is determined whether the count value, X, is less than a wind count value. If so, the depicted process proceeds to step 1976 at which a wind warning signal is generated. If it is determined at 1974 that the count value, X, is not less than the wind count value, the depicted process returns.

Although the present invention has been described in terms of specific embodiments, it is anticipated that alterations and modifications thereof will no doubt become apparent to those skilled in the art. It is therefore intended that the following claims be interpreted as covering all such alterations and modification as fall within the true spirit and scope of the invention.

What is claimed is:

1. A wave motion detector system for a swimming pool comprising:

transducer means responsive to positive and negative pressure changes in swimming pool water and operative to generate corresponding electrical signals;

comparator means responsive to said electrical signals, and operative to generate a crest signal while said positive pressure exceeds a predetermined positive threshold level, and a trough signal while said negative pressure is more negative than a predetermined negative threshold level;

pulse width discriminator means responsive to said crest signal and said trough signal and operative to generate, a qualified crest signal if said crest signal remains active for a first predetermined time interval, and a qualified trough signal if said trough signal remains active for a second predetermined time interval;

counting means responsive to said qualified crest signal and said qualified trough signal, and operative to determine a count value which is equal to the number of times said qualified trough signal and said qualified crest signal occur during a counting time interval;

alarm condition detection means responsive to said count value, and operative to generate an alarm signal if said count value is greater than or equal to a predetermined alarm count value;

annunciator means responsive to said alarm signal and operative to indicate an alarm condition if said alarm signal is generated.

2. A wave motion detector system as recited in claim 1 further comprising band pass filter means for preventing electrical signals having a frequency greater than a predetermined upper frequency, and lower than a predetermined lower frequency from passing from said transducer means to said comparator means.

3. A wave motion detector system as recited in claim 2 wherein said third predetermined time interval is approximately 750 milliseconds.

4. A wave motion detector system as recited in claim 2 wherein said predetermined upper frequency is approximately 2 Hz.

5. A wave motion detector system as recited in claim 2 wherein said predetermined lower frequency is approximately 1 Hz.

6. A wave motion detector system as recited in claim 1 wherein said pulse width discriminator means is further operative to generate a wide signal if said crest signal remains active for a third predetermined time interval, said wave motion detector system further including:

wind condition detection means responsive to said wide signal and said count value, and operative to generate a wind warning signal if said wide signal is active and said count value is less than a predetermined wind count value;

wherein said alarm condition detection means is further responsive to said wind signal, and further operative to hold said alarm signal inactive if said wind signal is active; and wherein said annunciator means is further responsive to said wind signal and further operative to indicate a wind warning condition if said wind signal is active.

7. A wave motion detector system as recited in claim 1 further including:

switch means operative to generate a closure signal in response to a closure of said switch;

ON/OFF control means responsive to said closure signal and operative to generate a system status signal indicative of whether said wave motion detector system is currently operating in an armed mode or in a disarmed mode;

wherein said alarm condition detection means is further responsive to said system status signal, and further operative to hold said alarm signal inactive if said wave motion detector system is currently disarmed; and wherein said wind condition detection means is further responsive to said system status signal, and further operative to hold said wind signal inactive if said wave motion detector system is currently disarmed.

8. A wave motion detector system as recited in claim 7 wherein said ON/OFF control means further includes logic means responsive to said closure signal, and operative to maintain operation of said wave motion detection system in said armed mode except in response to:

a first activation of said closure signal, which triggers the beginning of a first disarm time interval, and of a second disarm time interval;

a second activation of said closure signal after said first disarm time interval has elapsed; and a third activation of said closure signal after said second activation of said closure signal and before said second disarm time interval has elapsed.

9. A wave motion detector system as recited in claim 7 wherein said ON/OFF control means is responsive to said count value and said system status signal, and operative to cause said wave motion detection system to switch from said disarmed mode to said armed mode if said system status signal indicates that said system is disarmed and said count value does not reach a count of two during a dormancy interval.

10. A wave motion detector system as recited in claim 6 wherein said dormancy interval is approximately 17 minutes.

11. A wave motion detector system as recited in claim 1 further including:

a battery power supply operative to generate a supply voltage; and a voltage monitor circuit responsive to said supply voltage, and operative to generate a low battery signal if said supply voltage decreases below a predetermined low battery threshold voltage;

wherein said annunciator means is further responsive to said low battery signal and further operative to indicate a low battery warning condition if said low battery signal is active.

12. A wave motion detector system as recited in claim 1 wherein said count interval is controlled by a count interval timer means having:

timer enable means responsive to said qualified crest signal and said qualified trough signal, and operative to generate a count enable signal if said qualified trough signal is active within a first predetermined time period following generation of said qualified crest signal; and timer means responsive to said count enable signal, said qualified crest signal, and said qualified trough signal, and operative to generate a count interval signal if said qualified crest signal occurs within a second predetermined time period following generation of said count enable signal, said count interval signal remaining active for the duration of said counting time interval.

13. A wave motion detector system as recited in claim 1 wherein said counting time interval is approximately 8 seconds.

14. A wave motion detector system as recited in claim 1 wherein said first predetermined time interval is approximately 125 milliseconds.

15. A wave motion detector system as recited in claim 1 wherein said second predetermined time interval is approximately 125 milliseconds.

16. A wave motion detector system as recited in claim 1 wherein said predetermined alarm count value is equal to 5.

17. A wave motion detector system as recited in claim 3 wherein said predetermined wind count value is equal to 5.

18. A method for detecting and analyzing wave motion in a swimming pool:

sensing positive and negative pressure changes in swimming pool water and generating an electrical signal corresponding to pressure changes;

comparing the amplitude of said electrical signals to a predetermined positive threshold level and to a predetermined negative threshold level, and providing a crest signal which is active while said amplitude of said electrical signal exceeds said predetermined positive threshold level, and a trough signal which is active while said amplitude of said electrical signal is more negative than said predetermined negative threshold level;

generating a qualified crest signal if said crest signal remains active for a first predetermined time interval;

generating a qualified trough signal if said trough signal remains active for a second predetermined time interval;

determining a count value representative of the number of times said qualified trough signal and said qualified crest signal occur during a counting time interval;

comparing said count value to a predetermined alarm count value; and generating an alarm signal if said count value is greater than or equal to said predetermined alarm count value.

19. A method for detecting and analyzing wave motion in a swimming pool as recited in claim 18, further comprising the steps of:

generating a wide signal if said crest signal remains active for a third predetermined time interval;

generating a wind warning signal if said wide signal occurs and said count value is less than a predetermined wind count value; and holding said alarm signal inactive if said wind warning signal is active.

20. A method for detecting and analyzing wave motion in a swimming pool as recited in claim 18, further comprising the step of filtering electrical signals having a frequency greater than a predetermined upper frequency, and lower than a predetermined lower frequency before said step of comparing said amplitude of said electrical signal to a predetermined positive threshold level and to a predetermined negative threshold level.

* * * * *